US010239320B2

(12) United States Patent
Ueda

(10) Patent No.: US 10,239,320 B2
(45) Date of Patent: Mar. 26, 2019

(54) INKJET RECORDING APPARATUS CAPABLE OF SMOOTHLY SUPPLYING INK TO FIRST DAMPER CHAMBER AND SECOND DAMPER CHAMBER

(71) Applicant: BROTHER KOGYO KABUSHIKI KAISHA, Nagoya-shi, Aichi-ken (JP)

(72) Inventor: Toshiro Ueda, Inazawa (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 15/938,485

(22) Filed: Mar. 28, 2018

(65) Prior Publication Data

US 2018/0281423 A1 Oct. 4, 2018

(30) Foreign Application Priority Data

Mar. 31, 2017 (JP) ..... 2017-070384

(51) Int. Cl.

| | |
|---|---|
| ***B41J 2/17*** | (2006.01) |
| ***B41J 2/175*** | (2006.01) |
| ***B41J 2/14*** | (2006.01) |
| ***B41J 29/13*** | (2006.01) |
| ***B41J 29/38*** | (2006.01) |

(52) U.S. Cl.

CPC ..... *B41J 2/1707* (2013.01); *B41J 2/14201* (2013.01); *B41J 2/175* (2013.01); *B41J 2/17509* (2013.01); *B41J 2/17513* (2013.01); *B41J 2/17523* (2013.01); *B41J 2/17553* (2013.01); *B41J 2/17556* (2013.01); *B41J 2/17596* (2013.01); *B41J 29/13* (2013.01); *B41J 29/38* (2013.01); *B41J 2002/14483* (2013.01)

(58) Field of Classification Search

CPC .. B41J 2/1707; B41J 2/17553; B41J 2/17556; B41J 2/17596; B41J 2/14201; B41J 2/19; B41J 2002/14483

USPC ..... 347/47, 85, 86, 94

See application file for complete search history.

(56) References Cited

U.S. PATENT DOCUMENTS 5,963,237 A * 10/1999 Ikkatai ..... B41J 2/1652 347/85

6,033,064 A * 3/2000 Pawlowski, Jr. ..... B41J 2/175 347/87

(Continued)

FOREIGN PATENT DOCUMENTS

JP 2010-208152 A 9/2010

*Primary Examiner* — Huan Tran

*Assistant Examiner* — Alexander D Shenderov

(74) *Attorney, Agent, or Firm* — Merchant & Gould P.C.

(57) ABSTRACT

An inkjet recording apparatus includes: a first tank; a second tank; a recording portion including a first damper chamber and a second damper chamber; a first switch; a pump; a second switch; and a controller. The first switch is configured to be switched between a first state and a second state. The second switch is configured to be switched between a third state and a fourth state. After attachment of first and second cartridges to the inkjet recording apparatus, the controller performs an initial ink introduction including one of: a first drive process to drive the pump in a state where the first switch is in the first state and the second switch is in the fourth state; and a second drive process to drive the pump in a state where the first switch is in the second state and the second switch is in the third state.

14 Claims, 19 Drawing Sheets

(56) References Cited

U.S. PATENT DOCUMENTS

2007/0252860 A1* 11/2007 Nitta ..... B41J 2/175
347/14
2011/0279495 A1* 11/2011 Kuribayashi ..... B41J 2/175
347/6

* cited by examiner

INKJET RECORDING APPARATUS CAPABLE OF SMOOTHLY SUPPLYING INK TO FIRST DAMPER CHAMBER AND SECOND DAMPER CHAMBER

CROSS REFERENCE TO RELATED APPLICATION

This application claims priority from Japanese Patent Application No. 2017-070384 filed Mar. 31, 2017. The entire content of the priority application is incorporated herein by reference.

TECHNICAL FIELD

The present disclosure relates to an inkjet recording apparatus provided with a tank to which ink is supplied from a cartridge.

BACKGROUND

There is known an inkjet recording apparatus provided with an apparatus body and a cartridge detachably attached thereto. The cartridge is configured to supply ink stored therein to the tank. The apparatus body includes a tank configured to store ink from the cartridge therein and a recording head to which ink is supplied from the tank.

In such an inkjet recording apparatus, ink is not stored in the tank in an initial state (i.e., the inkjet recording apparatus has been unused). Thus, when the inkjet recording apparatus is in the initial state and is used for the first time, a cartridge needs to be attached to the inkjet recording apparatus to thereby supply ink in the cartridge to the tank.

Japanese Patent Application Publication No. 2010-208152 discloses an inkjet recording apparatus having a configuration capable of supplying ink from a cartridge to a tank smoothly. In this inkjet recording apparatus, the following operations are simultaneously performed: the tank is open to the atmosphere to enable ink stored in the cartridge to be supplied to the tank; and a negative pressure is generated in a recording head to cause ink stored in the tank to be sucked to the recording head.

SUMMARY

There is also known an inkjet recording apparatus capable of recording color images on sheets. In such an inkjet recording apparatus, a plurality of cartridges storing ink of different colors can be detachably attached to a main body. Further, in case that the inkjet recording apparatus is configured so as to be provided with tank(s), the plurality of tanks are provided corresponding to the plurality of cartridges. That is, the inkjet recording apparatus includes the plurality of tanks. Also in such the inkjet recording apparatus configured to receive the plurality of cartridges, in the initial state, it is required that ink is supplied from each of the cartridges to the corresponding tanks within a short period of time.

In view of the foregoing, it is an object of the disclosure to provide an inkjet recording apparatus in which ink can be supplied in a short period of time from a plurality of cartridges to a plurality of tanks in an initial state of the inkjet recording apparatus.

In order to attain the above and other objects, according to one aspect, the disclosure provides an inkjet recording apparatus to which a first cartridge and a second cartridge are attachable. The first cartridge is formed with a first storage space for storing a first ink and includes a first air passage allowing the first storage space to be communicated with an atmosphere. The second cartridge is formed with a second storage space for storing a second ink and includes a second air passage allowing the second storage space to be communicated with the atmosphere. The inkjet recording apparatus includes: a first tank; a second tank; a recording portion; a first switch; a pump; a second switch; and a controller. The first tank includes: a first storage chamber for storing the first ink supplied from the first cartridge; a first outlet port through which the first ink stored in the first storage chamber is allowed to flow out; and a first air flow path configured to allow the first storage chamber to be communicated with the atmosphere. The second tank includes: a second storage chamber for storing a second ink supplied from the second cartridge; a second outlet port through which the second ink stored in the second storage chamber is allowed to flow out; and a second air flow path configured to allow the second storage chamber to be communicated with the atmosphere. The recording portion includes: a first damper chamber; a second damper chamber; and a recording head. The first damper chamber is communicated with the first storage chamber through the first outlet port and configured to store the first ink supplied from the first storage chamber. The second damper chamber is communicated with the second storage chamber through the second outlet port and configured to store the second ink supplied from the second storage chamber. The recording head includes a nozzle and is configured to eject the first ink stored in the first damper chamber and the second ink stored in the second damper chamber through the nozzle. The first switch is configured to be switched between a first state and a second state. The first switch in the first state allows communication of the first air flow path with the atmosphere while interrupts communication of the second air flow path with the atmosphere. The first switch in the second state allows the communication of the second air flow path with the atmosphere while interrupts the communication of the first air flow path with the atmosphere. The pump includes: a suction port configured to allow a fluid to be sucked therethrough; and a discharge port through which the fluid sucked through the suction port is discharged. The second switch is configured to be switched between a third state and a fourth state. The second switch in the third state allows communication of the first damper chamber with the suction port while interrupts communication of the second damper chamber with the suction port. The second switch in the fourth state allows the communication of the second damper chamber with the suction port while interrupts the communication of the first damper chamber with the suction port. The controller is capable of controlling the first switch, the second switch and the pump. The controller is configured to perform: after attachment of the first cartridge and the second cartridge to the inkjet recording apparatus, an initial ink introduction including one of: a first drive process to drive the pump for a first period of time in a state where the first switch in the first state and the second switch is in the fourth state, to switch the first switch to the second state and to switch the second switch to the third state, and to drive the pump for a second period of time; and a second drive process to drive the pump for the second period of time in a state where the first switch is in the second state and the second switch is in the third state, to switch the first switch to the first state and to switch the second switch to the fourth state, and to drive the pump for the first period of time.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1A:
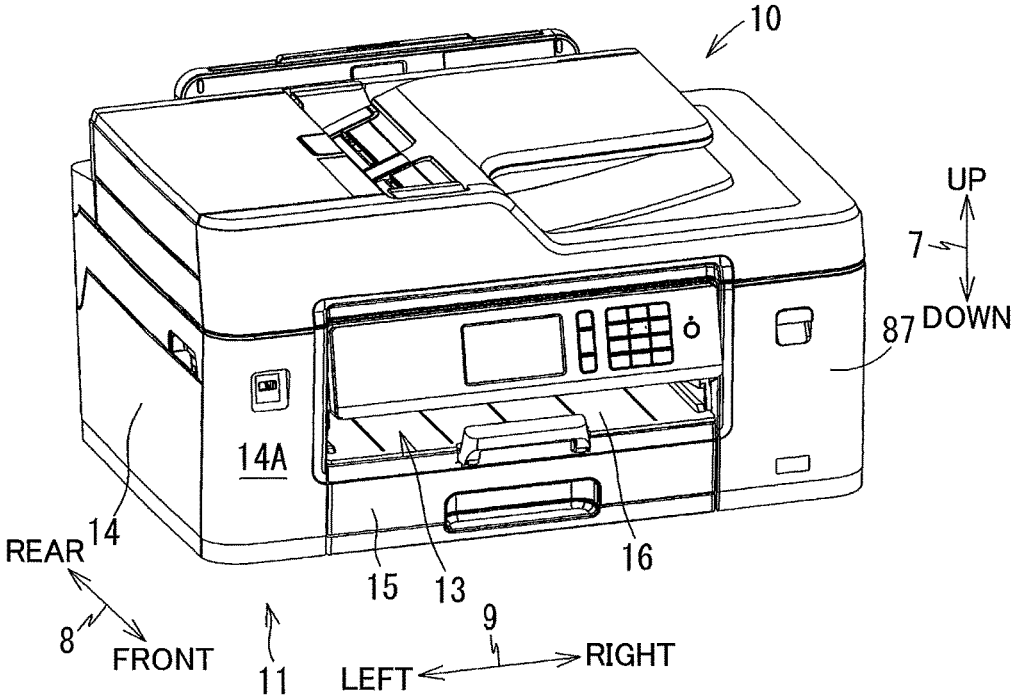
FIG. 1A is a perspective view of a multifunction peripheral 10 according to one embodiment of the present disclosure, and illustrating a closed position of a cover 87 of the multifunction peripheral 10.

A multifunction peripheral 10 as an example of an inkjet recording apparatus according to one embodiment of the present disclosure will be described with reference to the accompanying drawings, wherein like parts and components are designated by the same reference numerals to avoid duplicating description. It would be apparent that the embodiment described below is merely an example of the disclosure and may be modified in many ways without departing from the scope of the disclosure.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 is defined based on the operable posture of the multifunction peripheral 10. A front-rear direction 8 is defined assuming that a surface of the multifunction peripheral 10 formed with an opening 13 is a front surface of the multifunction peripheral 10 in the operable posture. A left-right direction 9 is defined based on an assumption that the multifunction peripheral 10 in the operable posture is viewed from its front surface. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

<Overall Structure of Multifunction Peripheral 10>

Figure 1B:
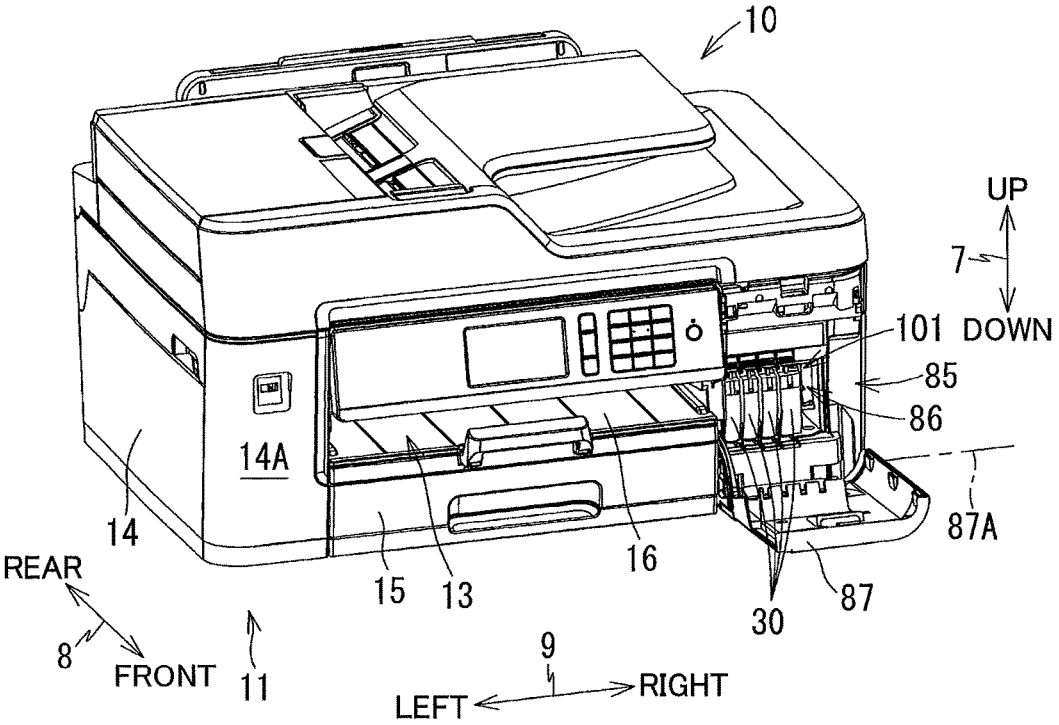
FIG. 1B is a perspective view of the multifunction peripheral 10 according to the embodiment, and illustrating an open position of the cover 87.

As illustrated in FIGS. 1A and 1B, the multifunction peripheral 10 has a substantially rectangular parallelepiped shape. The multifunction peripheral 10 has a lower portion in which a printer portion 11 is provided. The printer portion 11 is configured to record an image on a sheet of paper 12 (see FIG. 2) based on an inkjet recording method. The printer portion 11 includes a casing 14 whose front surface 14A is formed with the opening 13.

Figure 2:
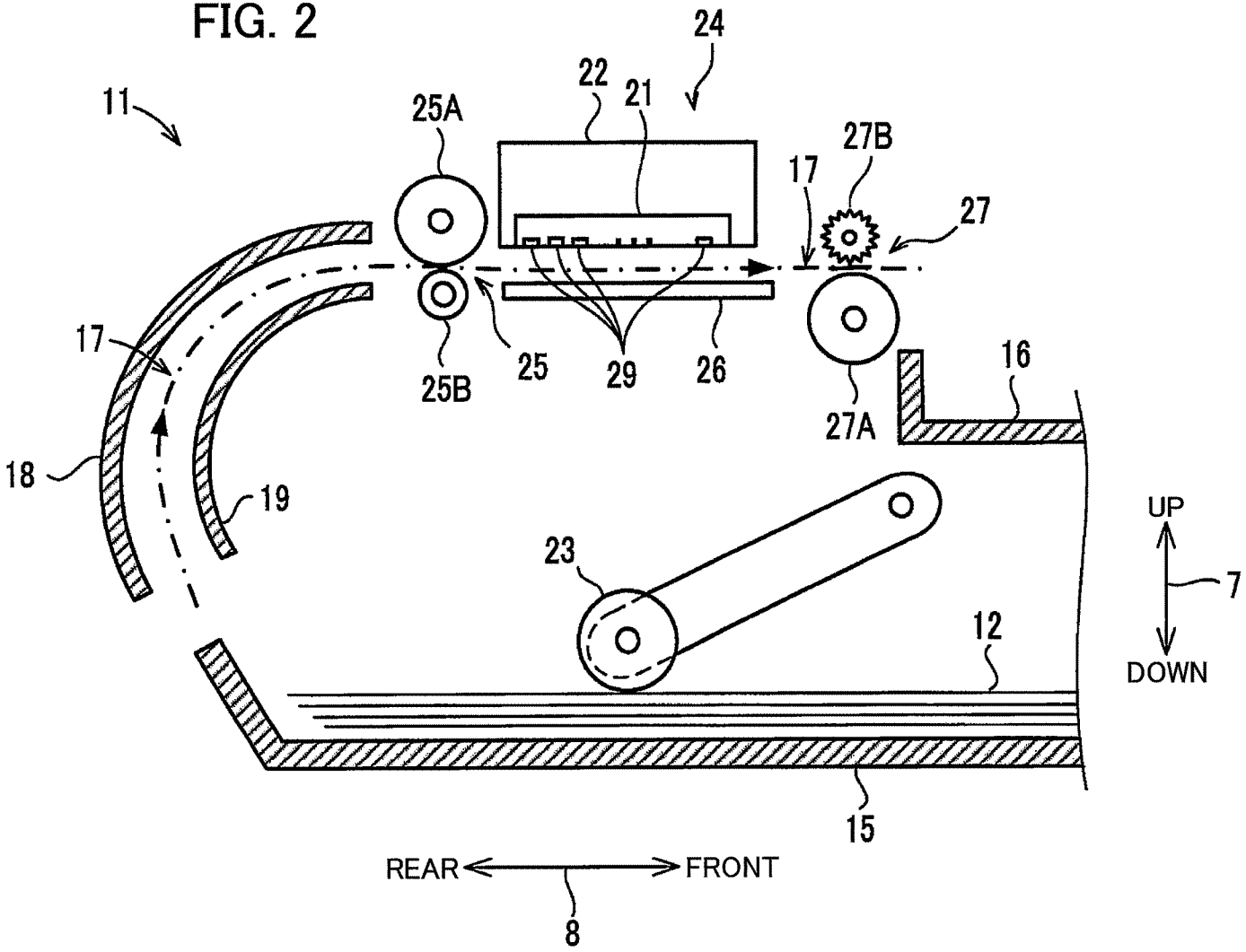
FIG. 2 is a vertical cross-sectional view schematically illustrating an internal configuration of a printer portion 11 of the multifunction peripheral 10 according to the embodiment.

As illustrated in FIG. 2, within the casing 14, a feeding roller 23, a feeding tray 15, a discharge tray 16, a pair of conveying rollers 25, a recording portion 24, a pair of discharging rollers 27, a platen 26, and a case 101 (see FIG. 1B) are disposed. The multifunction peripheral 10 has various functions such as a facsimile function and a printing function.

<Feeding Tray 15, Discharge Tray 16, and Feeding Roller 23>

As illustrated in FIGS. 1A and 1B, the feeding tray 15 is configured to be inserted into and extracted from the casing 14 through the opening 13 in the front-rear direction 8 by a user. The opening 13 is positioned at a center portion of the front surface 14A of the casing 14 in the left-right direction 9. As illustrated in FIG. 2, the feeding tray 15 is configured to support the sheets 12 in a stacked state.

The discharge tray 16 is disposed above the feeding tray 15. The discharge tray 16 is configured to support the sheets 12 discharged by the discharging rollers 27.

The feeding roller 23 is configured to feed each of the sheets 12 supported in the feeding tray 15 onto a conveying path 17. The feeding roller 23 is configured to be driven by a feeding motor 172 (see FIG. 8).

<Conveying Path 17>

As illustrated in FIG. 2, the conveying path 17 is a space partially defined by an outer guide member 18 and an inner guide member 19 opposing each other at a predetermined interval inside the printer portion 11. The conveying path 17 extends rearward from a rear end portion of the feeding tray 15, and then, makes a U-turn frontward while extending upward at a rear portion of the printer portion 11, passes through a space between the recording portion 24 and the platen 26, and reaches the discharge tray 16. A portion of the conveying path 17 positioned between the conveying rollers 25 and the discharging rollers 27 is provided substantially at a center portion of the multifunction peripheral 10 in the left-right direction 9, and extends in the front-rear direction 8. A conveying direction of each sheet 12 in the conveying path 17 is indicated by a dashed-dotted arrow in FIG. 2.

<Conveying Rollers 25>

As illustrated in FIG. 2, the pair of conveying rollers 25 is disposed at the conveying path 17. The conveying rollers 25 include a conveying roller 25A and a pinch roller 25B arranged to oppose each other. The conveying roller 25A is configured to be driven by a conveying motor 171 (see FIG. 8). The pinch roller 25B is configured to be rotated following rotation of the conveying roller 25A. As the conveying roller 25A makes forward rotation in response to forward rotation of the conveying motor 171, each of the sheets 12 is nipped between the conveying roller 25A and the pinch roller 25B to be conveyed in the conveying direction (i.e., frontward direction).

<Discharging Rollers 27>

As illustrated in FIG. 2, the pair of discharging rollers 27 is disposed downstream relative to the pair of conveying rollers 25 in the conveying direction at the conveying path 17. The discharging rollers 27 include a discharging roller 27A and a spur 27B arranged to oppose each other. The discharging roller 27A is configured to be driven by the conveying motor 171 (see FIG. 8). The spur 27B is configured to be rotated following rotation of the discharging roller 27A. As the discharging roller 27A makes forward rotation in response to the forward rotation of the conveying motor 171, each sheet 12 is nipped between the discharging roller 27A and the spur 27B and is conveyed in the conveying direction (i.e., frontward direction).

<Recording Portion 24>

As illustrated in FIG. 2, the recording portion 24 is disposed a position between the conveying rollers 25 and the discharging rollers 27 at the conveying path 17. The recording portion 24 is arranged to oppose the platen 26 in the up-down direction 7, with the conveying path 17 interposed between the recording portion 24 and the platen 26. The recording portion 24 is positioned above the conveying path 17, while the platen 26 is positioned below the conveying path 17. The recording portion 24 includes a carriage 22 and a recording head 21.

Figure 3:
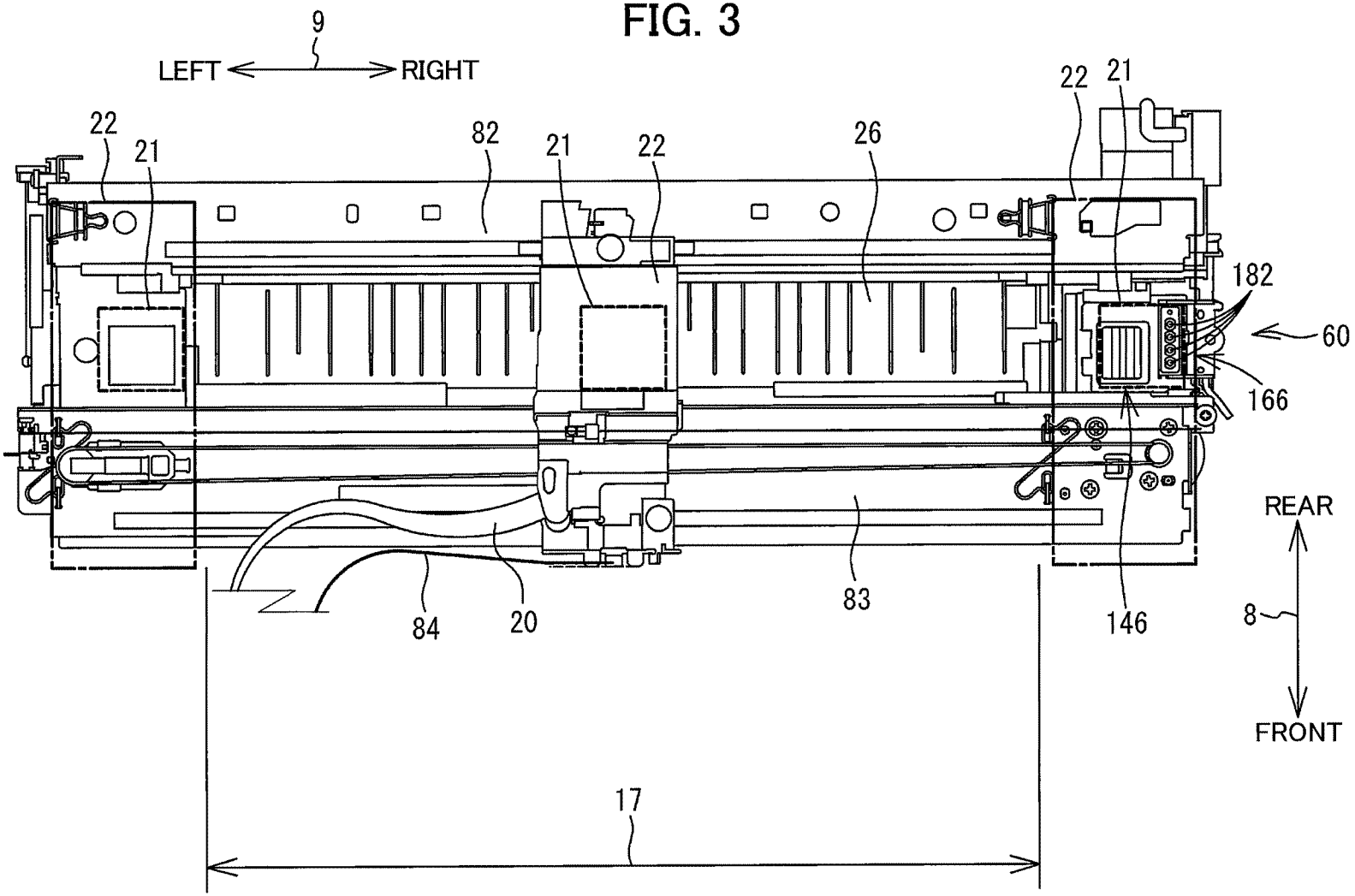
FIG. 3 is a plan view illustrating arrangement of a carriage 22 and a platen 26 in the multifunction peripheral 10 according to the embodiment.

As illustrated in FIG. 3, the carriage 22 is supported by guide rails 82 and 83. The guide rails 82 and 83 extend in the left-right direction 9 and are spaced apart from each other in the front-rear direction 8. The guide rails 82 and 83 are supported by a frame (not illustrated) of the printer portion 11. The carriage 22 is connected to a well-known belt mechanism provided at the guide rail 83. The belt mechanism is driven by a carriage-driving motor 173 (see FIG. 8). The carriage 22 connected to the belt mechanism is configured to make reciprocating movements in the left-right direction 9 in response to driving of the carriage-driving motor 173. The carriage 22 is configured to move within a range from a right side relative to a right end of the conveying path 17 to a left side relative to a left end of the conveying path 17, as indicated by alternate long and short dash lines in FIG. 3.

As illustrated in FIG. 3, a bundle of ink tubes 20 and a flexible flat cable 84 extend from the carriage 22.

The ink tubes 20 connect the case 101 (see FIG. 1B) to the recording head 21. Each of the ink tubes 20 is configured to supply ink stored in a corresponding ink cartridge 30 (an example of a cartridge) attached to the case 101 to the recording head 21. Four ink tubes 20 are provided in one-to-one correspondence with the respective ink cartridges 30 so that ink of respective four colors (black, magenta, cyan, and yellow) can flow through the corresponding internal spaces of the ink tubes 20. These four ink tubes 20 are bundled and connected to the carriage 22.

The flexible flat cable 84 is configured to establish electrical connection between a controller 130 (see FIG. 8) and the recording head 21. The flexible flat cable 84 is configured to transmit control signals outputted from the controller 130 to the recording head 21.

As illustrated in FIG. 2, the recording head 21 is mounted on the carriage 22. As illustrated in FIG. 9, the carriage 22 is formed with damper chambers 44 for temporarily storing ink supplied through the ink tubes 20. In the present embodiment, the damper chambers 44 include one damper chamber 44BK (an example of a first damper chamber) configured to store black ink supplied through the ink tube 20 and three damper chambers 44CL (an example of a second damper chamber) configured to store color ink supplied through the corresponding ink tubes 20. The three damper chambers 44CL are configured to store ink of magenta, cyan, and yellow. The recording head 21 is configured to eject the ink stored in the damper chambers 44 through a plurality of nozzles 29. Specifically, the controller 130 selectively applies a drive voltage to a plurality of piezoelectric elements 45 (see FIG. 8) provided corresponding to the plurality of nozzles 29, whereby the recording head 21 selectively ejects ink through the plurality of nozzles 29.

Note that, in FIG. 9, only one damper chamber 44CL is illustrated, while the other two damper chambers 44CL are omitted. In the following description and the drawings, only one damper chamber 44CL is assumed to be provided unless otherwise specified.

The recording portion 24 is configured to be controlled by the controller 130. As the carriage 22 moves in the left-right direction 9, the recording head 21 ejects ink droplets, through the nozzles 29, toward the sheet 12 supported by the platen 26. In this way, an image is recorded on each sheet 12, and the ink stored in each of the ink cartridges 30 is consumed.

<Platen 26>

As illustrated in FIG. 2, the platen 26 is disposed between the conveying rollers 25 and the discharging rollers 27 at the conveying path 17. The platen 26 is arranged to oppose the recording portion 24 in the up-down direction 7, with the conveying path 17 interposed between the platen 26 and the recording portion 24. The platen 26 supports the sheet 12 conveyed by the conveying rollers 25 from below.

<Cover 87>

As illustrated in FIG. 1B, the front surface 14A of the casing 14 has a right end portion formed with an opening 85. Rearward of the opening 85, an accommodation space 86 is formed to accommodate the cartridge-attachment portion 110 therein. A cover 87 is assembled to the casing 14 so as to be capable of covering the opening 85. The cover 87 is pivotally movable, about a pivot axis 87A (pivot center) extending in the left-right direction 9, between a closed position (a position illustrated in FIG. 1A) for closing the opening 85 and an open position (a position illustrated in FIG. 1B) for exposing the opening 85.

<Case 101>

Figure 4:
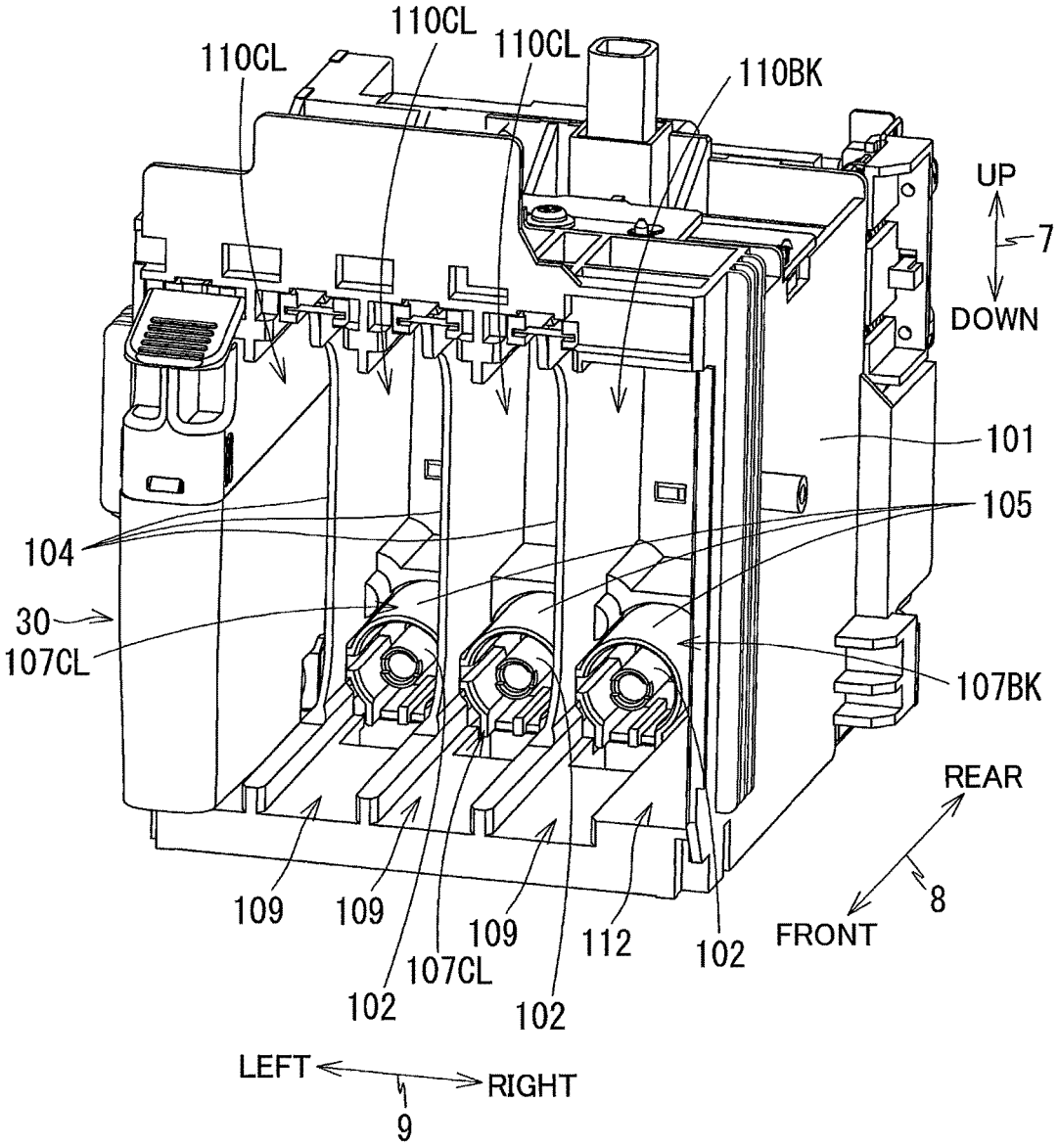
FIG. 4 is a perspective view illustrating an external appearance of a cartridge-attachment portion 110 of the multifunction peripheral 10 according to the embodiment as viewed from a side thereof at which an opening 112 is formed.
Figure 5:
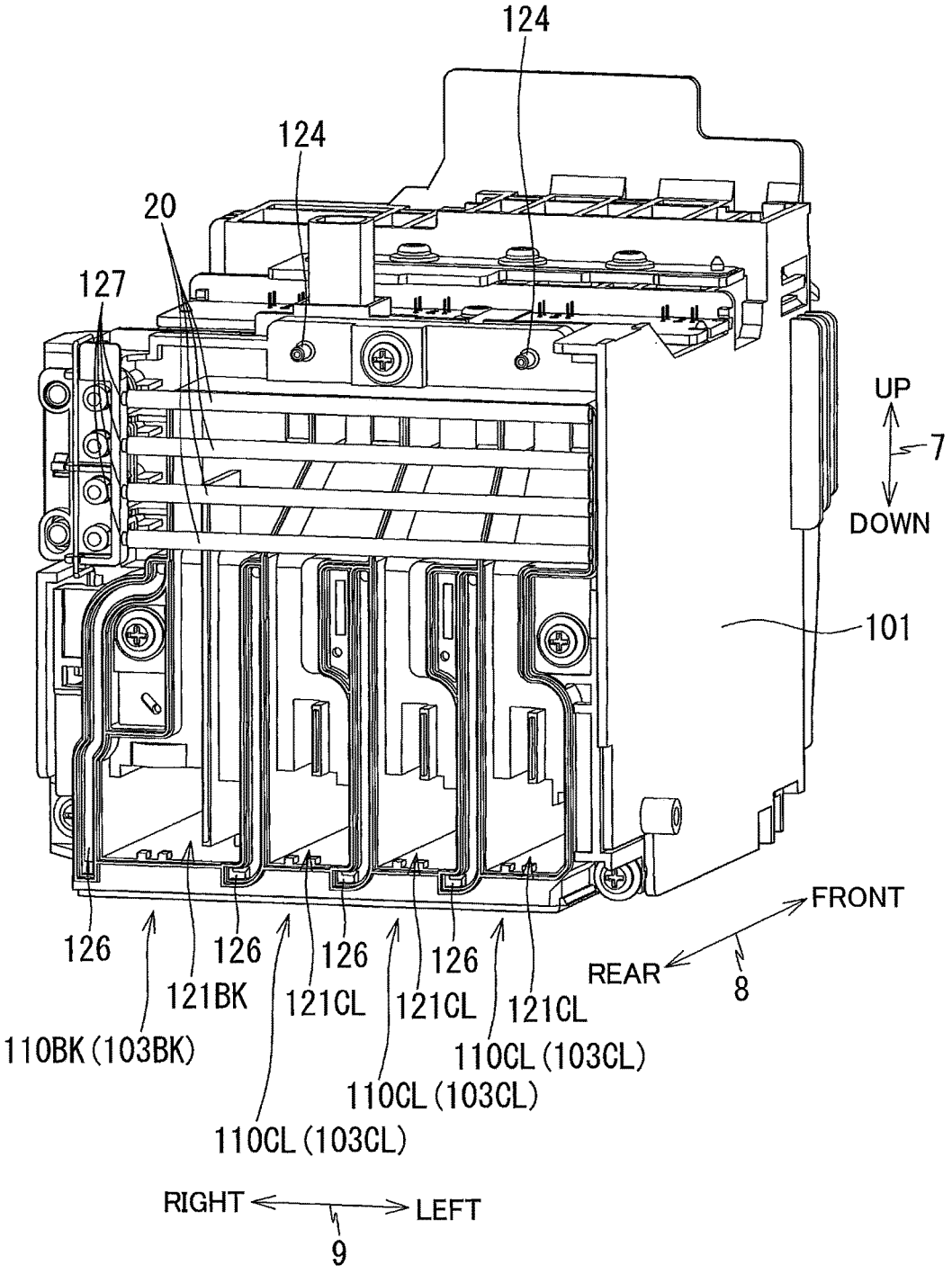
FIG. 5 is a perspective view illustrating the external appearance of the cartridge-attachment portion 110 as viewed from a side thereof at which tanks 103 are disposed.

As illustrated in FIGS. 4 and 5, the case 101 has a box-like shape defining an internal space therein. More specifically, the case 101 has a box-like shape having a top wall defining the top part of the internal space of the case 101, a bottom wall defining the bottom part of the internal space, a rear wall connecting the top wall to the bottom wall, and an opening 112 provided at a position facing the rear wall in the front-rear direction 8. The opening 112 can be exposed to the front surface 14A of the casing 14 that a user faces when using the multifunction peripheral 10.

The ink cartridges 30 can be inserted into and extracted from the case 101 through the opening 85 of the casing 14 and the opening 112 of the case 101. In the case 101, the bottom wall is formed with four guide grooves 109 for guiding insertion and extraction of the respective ink cartridges 30 in the front-rear direction 8 (see FIG. 4). Movements of the ink cartridges 30 in the front-rear direction 8 are guided by the corresponding guide grooves 109 as lower end portions of the ink cartridges 30 are inserted into the corresponding guide grooves 109. The case 101 is also provided with three plates 104 that partition the internal space of the case 101 into four individual spaces each elongated in the up-down direction 7. Each of the four spaces partitioned by the plates 104 is configured to receive one of the four ink cartridges 30.

The internal space of the case 101 configured to receive the ink cartridges 30 serves as cartridge-attachment portions 110. In the present embodiment, the cartridge-attachment portions 110 include one cartridge-attachment portion 110BK (an example of a first cartridge-attachment portion) to which the ink cartridge 30 storing black ink is attached and three cartridge-attachment portions 110CL (an example of a second cartridge-attachment portion) to which the ink cartridges 30 storing color ink are respectively attached. More specifically, the ink cartridges 30 storing magenta ink, the ink cartridge 30 storing cyan ink, and the ink cartridge 30 storing yellow ink is attached to the three cartridge-attachment portions 110CL, respectively.

As illustrated in FIG. 9, the cartridge-attachment portion 110BK includes a connecting portion 107BK, a plurality of contacts 106BK, a rod 125BK, an attachment sensor 113BK (an example of a first sensor), and a tank 103BK (an example of a first tank). Each of the three cartridge-attachment portion 110CL includes a connecting portion 107CL, a plurality of contacts 106CL, a rod 125CL, an attachment sensor 113CL (an example of a second sensor), and a tank 103CL (an example of a second tank). The cartridge-attachment portion 110BK includes four contacts 106BK for the ink cartridge 30 storing black ink, and each of the three cartridge-attachment portion 110CL includes four contacts 106CL for the corresponding ink cartridge 30 storing color ink. In other words, a total of 16 (sixteen) contacts 106 are provided for the four ink cartridges 30.

Note that, in FIG. 9, only one cartridge-attachment portion 110CL is illustrated, and the remaining two cartridge-attachment portion 110CL are omitted. In the following description, only one cartridge-attachment portion 110CL is assumed to be provided unless otherwise specified.

The cartridge-attachment portion 110BK and the cartridge-attachment portion 110CL have the same configurations as each other. The connecting portion 107BK and the connecting portion 107CL have the same configurations as each other. The plurality of contacts 106BK and the plurality of contacts 106CL have the same configurations as each other. The rod 125BK and the rod 125CL have the same configurations as each other. The attachment sensor 113BK and the attachment sensor 113CL have the same configurations as each other. The tank 103BK and the tank 103CL have substantially the same configurations as each other except that the tank 103BK has a capacity greater than a capacity of the tank 103CL. Accordingly, hereinafter, descriptions will be made only for the configurations of the connecting portion 107BK, the plurality of contacts 106BK, the rod 125BK, the attachment sensor 113BK, and the tank 103BK, while descriptions for the configurations of the connecting portion 107CL, the plurality of contacts 106CL, the rod 125CL, the attachment sensor 113CL, and the tank 103CL will be omitted for simplifying description.

Figure 6:
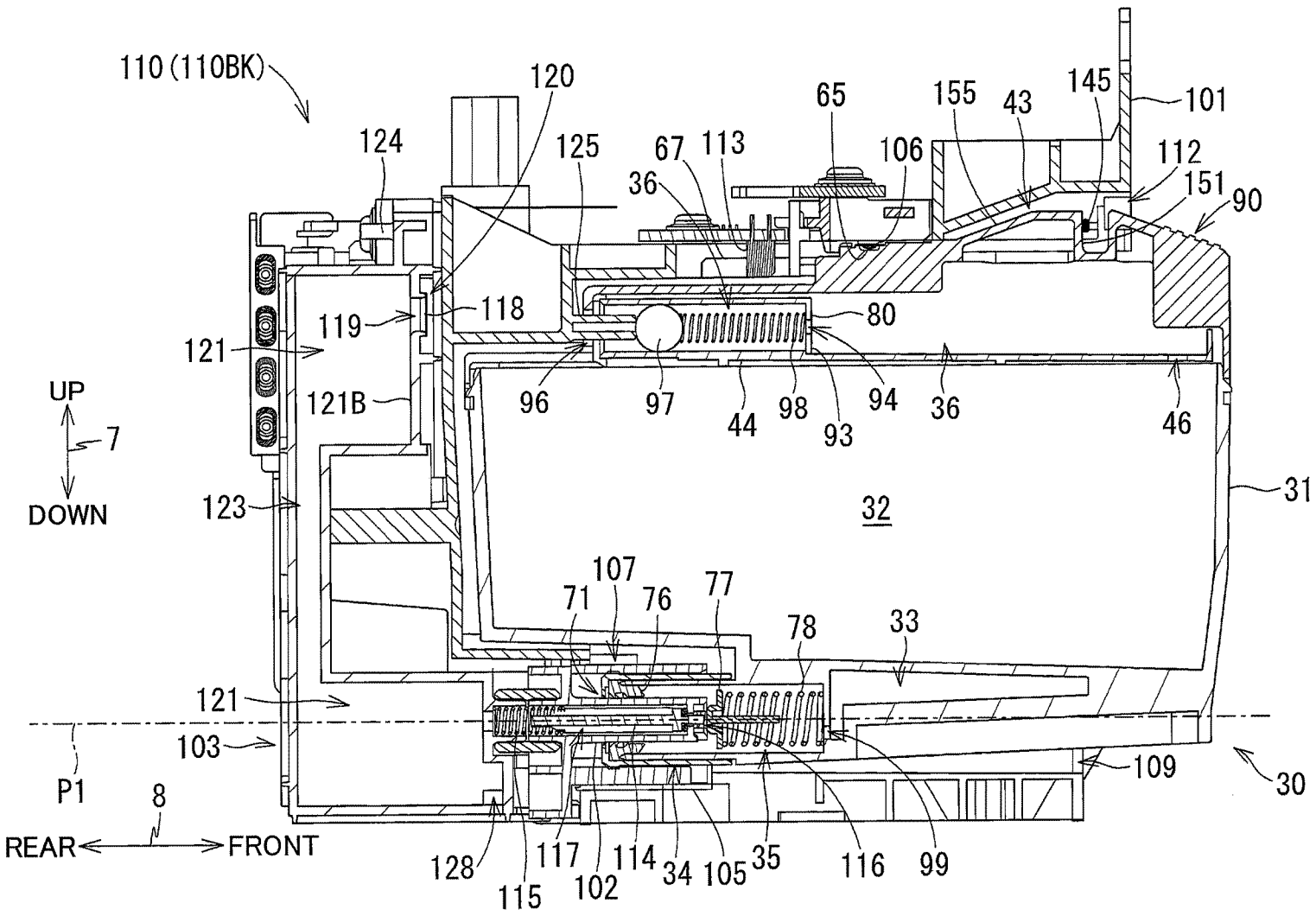
FIG. 6 is a cross-sectional view of the cartridge-attachment portion 110 and an ink cartridge 30 according to the embodiment, and illustrating a state where the ink cartridge 30 is attached to the cartridge-attachment portion 110.

Further, in the descriptions for the configurations of the connecting portion 107BK, the contacts 106BK, the rod 125BK, the attachment sensor 113BK, and the tank 103BK and in FIG. 6, the connecting portion 107BK, the contacts 106BK, the rod 125BK, the attachment sensor 113BK, and the tank 103BK are simply referred to as "connecting portion 107", "contacts 106", "rod 125", "attachment sensor 113", and "tank 103", respectively.

<Connecting Portion 107>

As illustrated in FIG. 4, the connecting portion 107 has an ink needle 102 and a guide portion 105.

The ink needle 102 is made of resin, and has a generally tubular shape. The ink needle 102 is disposed at a lower portion of the rear wall of the case 101. More specifically, the ink needle 102 is disposed on the rear wall of the case 101 at a position corresponding to an ink supply portion 34 (described later) of the ink cartridge 30 attached to the cartridge-attachment portion 110 (see FIG. 6). The ink needle 102 protrudes frontward from the rear wall of the case 101.

The guide portion 105 has a cylindrical shape, and is disposed at the rear wall of the case 101 to surround the ink needle 102. The guide portion 105 protrudes frontward from the rear wall of the case 101. A protruding end (front end) of the guide portion 105 is open. The ink needle 102 is positioned at a diametrical center of the guide portion 105. The guide portion 105 is so shaped that the ink supply portion 34 of the attached ink cartridge 30 is received in the guide portion 105.

The connecting portion 107 is not connected to the ink supply portion 34 of the ink cartridge 30 in a state where the ink cartridge 30 is not attached to the cartridge-attachment portion 110. On the other hand, during insertion of the ink cartridge 30 into the cartridge-attachment portion 110, that is, in the course of action for bringing the ink cartridge 30 into an attached position (i.e., a position illustrated in FIG. 6), the ink supply portion 34 of the ink cartridge 30 enters the guide portion 105. As the ink cartridge 30 is further inserted rearward into the cartridge-attachment portion 110, the ink needle 102 is inserted into an ink supply port 71 formed in the ink supply portion 34. As a result, the connecting portion 107 is connected to the ink supply portion 34. Hence, ink stored in a storage chamber 33 formed in the ink cartridge 30 is allowed to flow into the corresponding tank 103 through an ink valve chamber 35 formed in the ink supply portion 34 and an internal space 117 defined in the ink needle 102.

Incidentally, the ink needle 102 may have a flat-shaped tip end or a pointed tip end.

As illustrated in FIG. 6, a valve 114 and a coil spring 115 are accommodated in the internal space 117 of the ink needle 102. The valve 114 is movable in the front-rear direction 8 to open and close an opening 116 formed in the protruding end of the ink needle 102. That is, the valve 114 is configured to open and close the internal space 117 of the ink needle 102. The coil spring 115 urges the valve 114 frontward. Accordingly, the valve 114 closes off the opening 116 in a state where no external force is applied to the valve 114 (i.e., in a state where the ink cartridge 30 is not attached to the cartridge-attachment portion 110). Further, a front end portion of the valve 114 urged by the coil spring 115 protrudes frontward relative to the opening 116 in a state where no external force is applied to the valve 114. In the process of connecting the connecting portion 107 to the ink supply portion 34, the valve 114 opens the opening 116. Details on how the valve 114 opens the opening 116 will be described later.

<Contacts 106>

As illustrated in FIG. 6, each of the four contacts 106 is provided on the upper wall of the case 101. Each of the four contacts 106 protrudes downward toward the internal space of the case 101 from the upper wall of the case 101. Although not illustrated in detail in the drawings, the four contacts 106 are arranged spaced apart from one another in the left-right direction 9. Each of the four contacts 106 is arranged at a position corresponding to each one of four electrodes 65 (described later) of the ink cartridge 30. Each contact 106 is made of a material having electrical conductivity and resiliency. The contacts 106 are therefore upwardly resiliently deformable. Note that the number of the contacts 106 and the number of electrodes 65 may be arbitrary.

Each contact 106 is electrically connected to the controller 130 (see FIG. 8) via an electrical circuit. When the contacts 106 are respectively engaged with the corresponding electrodes 65 and electrically connected thereto, a certain voltage Vc is applied to one of the electrodes 65, another one of the electrodes 65 is grounded, and electric power is supplied to still another one of the electrodes 65, for example. Due to establishment of the electrical connection between the contacts 106 and the corresponding electrodes 65, the controller 130 is allowed to access data stored in an IC of the corresponding ink cartridges 30. Outputs from the electrical circuits are configured to be inputted into the controller 130.

<Rod 125>

As illustrated in FIG. 6, the rod 125 is provided at the rear wall of the case 101 at a position above the ink needle 102. The rod 125 protrudes frontward from the rear wall of the case 101. The rod 125 has a cylindrical shape. The rod 125 is configured to be inserted into an air communication port 96 (described later) of the ink cartridge 30 in a state where the ink cartridge 30 is attached to the cartridge-attachment portion 110, that is, in a state where the ink cartridge 30 is in the attached position.

<Attachment Sensor 113>

As illustrated in FIG. 6, the attachment sensor 113 is also disposed at the upper wall of the case 101. The attachment sensor 113 is configured to detect whether or not the ink cartridge 30 is attached to the cartridge-attachment portion 110. The attachment sensor 113 is disposed at a position frontward of the rod 125 but rearward of the contacts 106. In the present embodiment, the attachment sensor 113 includes a light-emitting portion and a light-receiving portion. The light-emitting portion is positioned rightward or leftward relative to the light-receiving portion so as to be spaced apart therefrom in the left-right direction 9. When the ink cartridge 30 has been attached to the cartridge-attachment portion 110, a light-blocking plate 67 (described later) of the attached ink cartridge 30 is disposed between the light-emitting portion and the light-receiving portion of the attachment sensor 113. In other words, the light-emitting portion and the light-receiving portion are arranged to oppose each other, with the light-blocking plate 67 of the attached ink cartridge 30 interposed between the light-emitting portion and the light-receiving portion.

The attachment sensor 113 is configured to output different detection signals depending on whether or not light emitted from the light-emitting portion in the left-right direction 9 is received by the light-receiving portion. For example, the attachment sensor 113 is configured to output a low-level signal to the controller 130 (see FIG. 8) in case that the light-receiving portion does not receive the light emitted from the light-emitting portion (that is, when an intensity of the light received at the light-receiving portion is less than a predetermined intensity). On the other hand, the attachment sensor 113 is configured to output a high-level signal to the controller 130 in case that the light emitted from the light-emitting portion is received by the light-receiving portion (that is, when the intensity of the received light is equal to or greater than the predetermined intensity).

Figure 8:
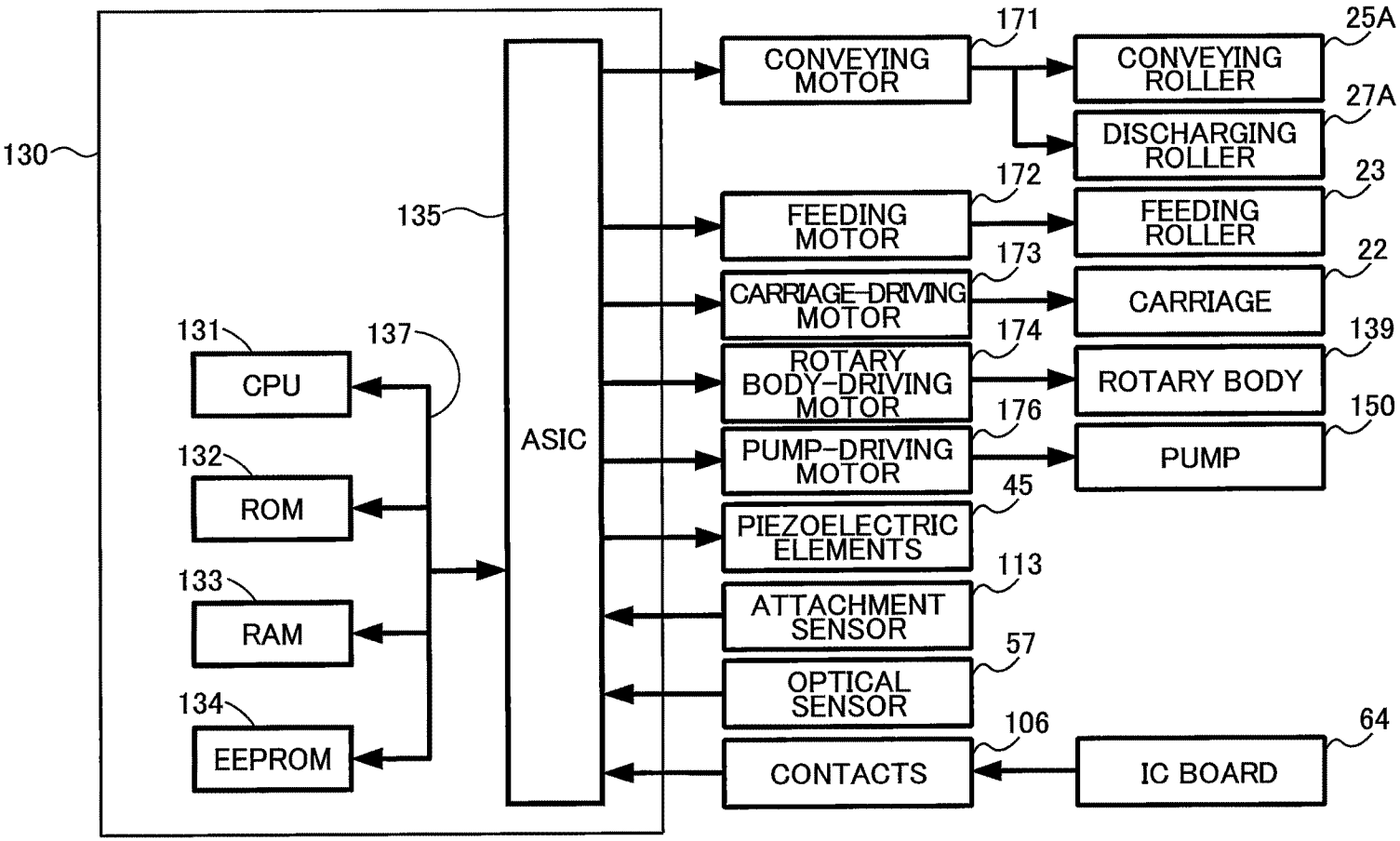
FIG. 8 is a block diagram illustrating a configuration of a controller 130 of the multifunction peripheral 10 according to the embodiment.
Figure 9:
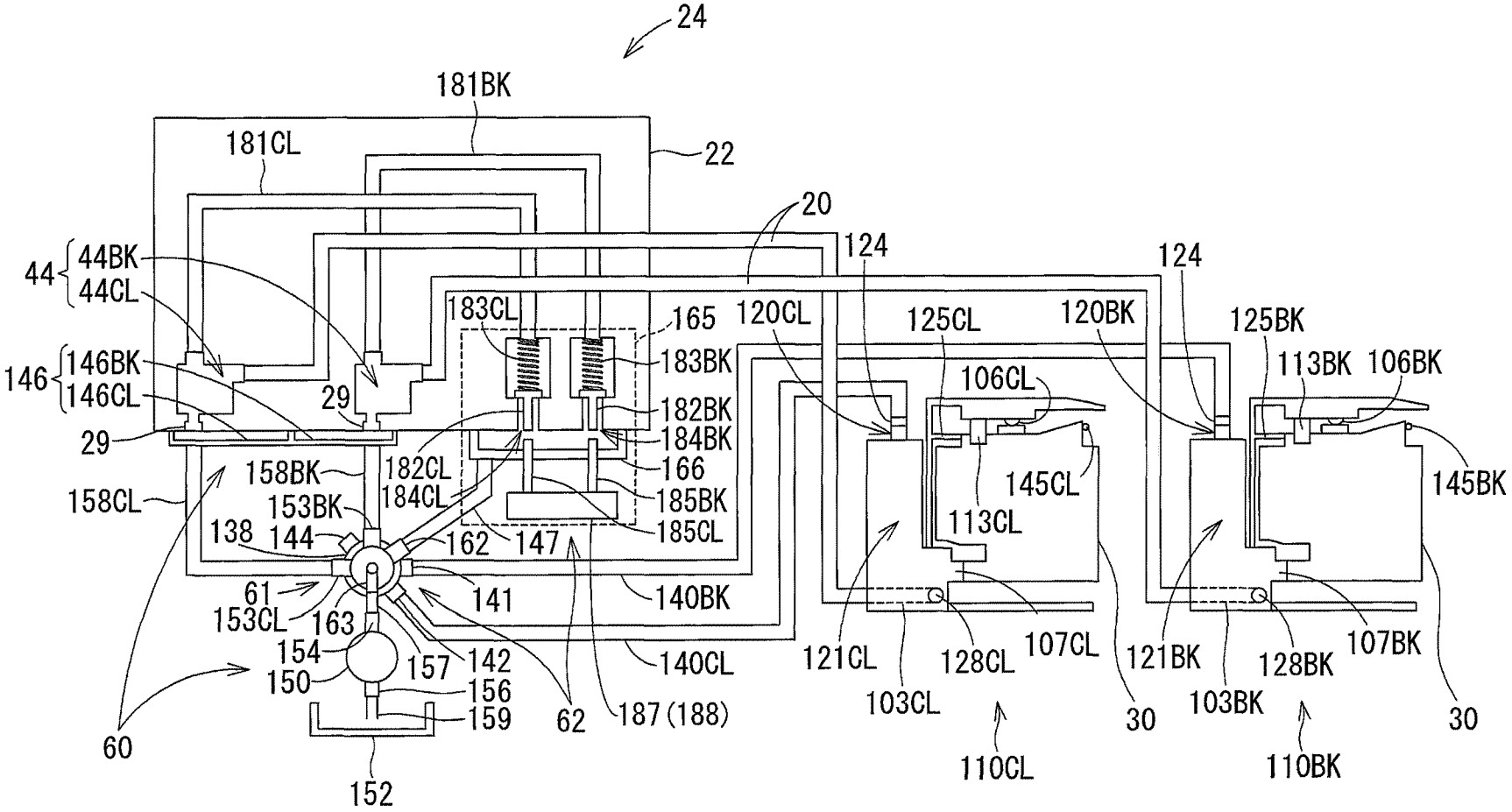
FIG. 9 is a cross-sectional view schematically illustrating the ink cartridge 30, the cartridge-attachment portion 110, a recording portion 24, a first switch mechanism 61, and a second switch mechanism 62 in the multifunction peripheral 10 according to the embodiment.

The light-receiving portion of the attachment sensor 113BK can receive the light emitted from the light-emitting portion in a state where the ink cartridge 30 is not attached to the cartridge-attachment portion 110BK, so that the attachment sensor 113BK outputs a high-level signal to the controller 130 (see FIG. 8). On the other hand, in a state where the ink cartridge 30 is attached to the cartridge-attachment portion 110BK, the light outputted from the light-emitting portion is blocked by the light-blocking plate 67 before arriving at the light-receiving portion of the attachment sensor 113BK, so that the attachment sensor 113BK outputs a low-level signal (an example of a first signal) to the controller 130.

In a state where the ink cartridge 30 is not attached to the cartridge-attachment portion 110CL, the light-receiving portion can receive the light outputted from the light-emitting portion of the attachment sensor 113CL. Therefore, the attachment sensor 113CL outputs a high-level signal to the controller 130. On the other hand, in a state where the ink cartridge 30 is attached to the cartridge-attachment portion 110CL, the light outputted from the light-emitting portion is blocked by the light-blocking plate 67 before the light arrives at the light-receiving portion of the attachment sensor 113CL. Accordingly, the attachment sensor 113CL outputs a low-level signal (an example of a second signal) to the controller 130.

<Lock Shaft 145>

As illustrated in FIG. 6, a lock shaft 145 extends in the left-right direction 9 at a position in the vicinity of the upper wall of the case 101 and in the vicinity of the opening 112. The lock shaft 145 is a bar-like member extending in the left-right direction 9. The lock shaft 145 is, for example, a metal column. The lock shaft 145 has left and right ends fixed to walls defining left and right ends of the case 101. The lock shaft 145 extends in the left-right direction 9 over the four spaces of the case 101 (i.e., the cartridge-attachment portion 110BK and the three cartridge-attachment portion 110CL) in which the four ink cartridges 30 can be respectively accommodated.

The lock shaft 145 is configured to hold each of the ink cartridges 30 attached to the cartridge-attachment portion 110 at the attached position. The ink cartridges 30 are respectively engaged with the lock shaft 145 in a state where the ink cartridges 30 are attached to the cartridge-attachment portions 110. The lock shaft 145 is configured to retain each ink cartridge 30 in the cartridge-attachment portion 110 against urging forces of coil springs 78 and 98 of the ink cartridge 30 that push the ink cartridge 30 frontward.

<Tanks 103>

As illustrated in FIGS. 5 and 6, the tank 103 is provided at a position rearward of the case 101. The tank 103 has a generally box shape formed with a storage chamber 121 therein.

The storage chamber 121 is communicated with the internal space 117 of the ink needle 102 at the front side thereof, thereby allowing ink to flow out from the ink cartridge 30 attached to the cartridge-attachment portion 110 in which the storage chamber 121 is provided and to be stored in the storage chamber 121 through the ink needle 102. That is, ink is supplied from the ink cartridge 30 attached to the cartridge-attachment portion 110 to the storage chamber 121.

The storage chamber 121 is also communicated with an ink passage 126 through a communication port 128. The communication port 128 is formed in a side wall defining a lower portion of the storage chamber 121. The communication port 128 is positioned below the connecting portion 107.

The ink passage 126 extends upward from the storage chamber 121 and is connected to an ink outlet port 127 (see FIG. 5). As illustrated in FIG. 5, each ink outlet port 127 is connected to the corresponding one of the ink tubes 20. With this configuration, ink stored in the storage chamber 121 is allowed to flow into the ink passage 126 through the communication port 128, and to be supplied to the damper chamber 44 of the carriage 22 through the ink passage 126 and the ink tube 20.

As illustrated in FIG. 6, the storage chamber 121 is communicated with an air communication port 124 (see FIG. 5) provided upward of the tank 103. The storage chamber 121 is communicated with the air communication port 124 through a through-hole 119 formed in a front wall 121B defining a front end of an upper portion of the storage chamber 121 and an air flow path 120. The through-hole 119 is sealed with a semi-permeable membrane 118. The air communication port 124 is open to the outside through a first switch mechanism 61 (described later). With this configuration, the storage chamber 121 is configured to be open to the atmosphere.

Hereinafter, the storage chamber 121 formed in the tank 103BK is referred to as "storage chamber 121BK" (an example of a first storage chamber), and the storage chamber 121 formed in each tank 103CL is referred to as "storage chamber 121CL" (an example of a second storage chamber). The communication port 128 formed in the tank 103BK is referred to as "communication port 128BK" (an example of a first outlet port), and the communication port 128 formed in each tank 103CL is referred to as "communication port 128CL" (an example of a second outlet port). The air flow path 120 formed in the tank 103BK is referred to as "air flow path 120BK" (an example of a first air flow path), while the air flow path 120 formed in each tank 103CL is referred to as "air flow path 120CL" (an example of a second air flow path).

In the present embodiment, the storage chamber 121BK has a capacity greater than a capacity of each storage chamber 121CL. The black ink configured to be stored in the storage chamber 121BK is pigment ink, while the ink of magenta, cyan, and yellow respectively configured to be stored in the three storage chambers 121CL is dye ink.

Although not illustrated in FIG. 5, each tank 103 has a rear end portion sealed with a film. That is, the film constitutes a rear end of each tank 103. Stated differently, the film constitutes rear ends of the storage chamber 121 and the ink passage 126.

<First Switch Mechanism 61>

As illustrated in FIG. 9, the multifunction peripheral 10 further includes the first switch mechanism 61 (an example of a first switch). The first switch mechanism 61 is configured to be switched at least between a first state and a second state (described later) to switch a communication state of the air flow path 120BK and the air flow paths 120CL with the atmosphere.

Figure 10A:
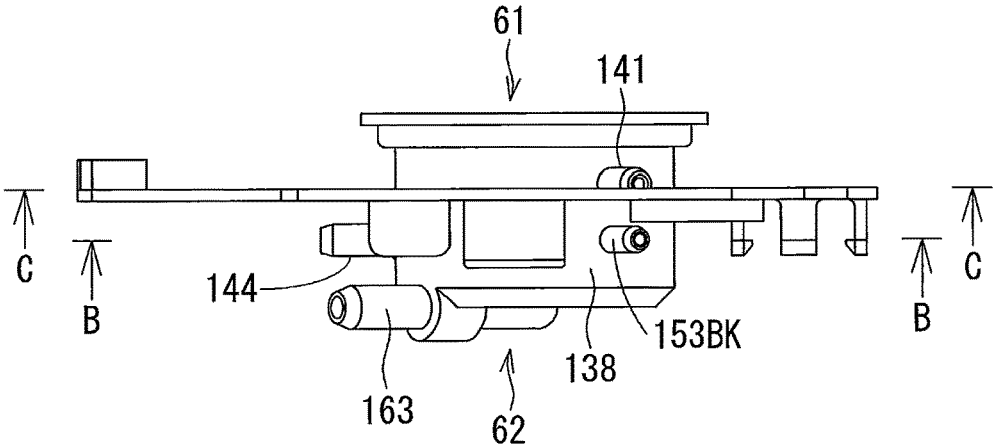
FIG. 10A is a front view illustrating a second state of the first switch mechanism 61 and a third state of the second switch mechanism 62.
Figure 10B:
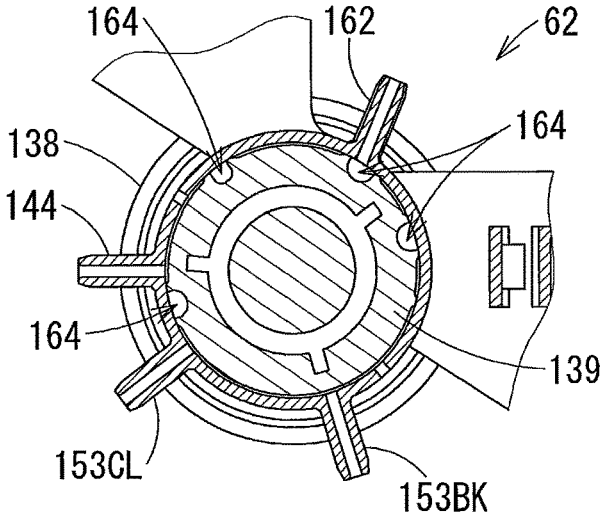
FIG. 10B is a cross-sectional view of FIG. 10A taken along a line B-B.
Figure 10C:
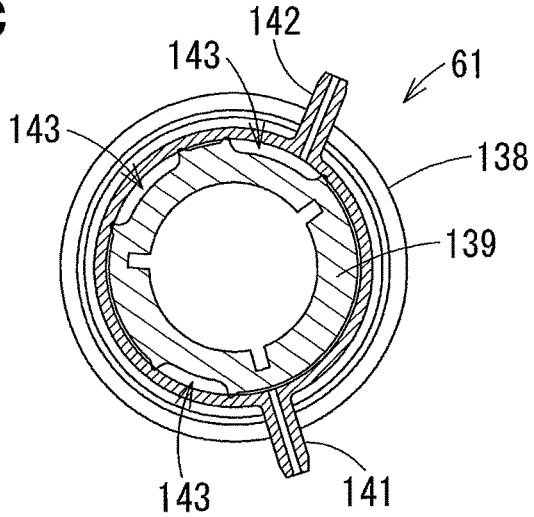
FIG. 10C is a cross-sectional view of FIG. 10A taken along a line C-C.

As illustrated in FIGS. 10A and 10C, the first switch mechanism 61 includes a cylinder 138 having a cylindrical shape, and a rotary body 139 having a columnar shape and disposed inside the cylinder 138.

Note that an upper portion of the cylinder 138 and an upper portion of the rotary body 139 correspond to the first switch mechanism 61, while a lower portion of the cylinder 138 and a lower portion of the rotary body 139 correspond to a second switch mechanism 62 (described later, see FIGS. 10A and 10B). A portion of the rotary body 139 constituting the first switch mechanism 61 is an example of a first movable member, and a portion of the rotary body 139 constituting the second switch mechanism 62 is an example of a second movable member.

As illustrated in FIG. 10C, a first port 141 (see FIG. 10A) and a second port 142 are formed at the upper portion of the cylinder 138. The upper portion of the cylinder 138 and the upper portion of the rotary body 139 provide spaces 143 therebetween. The spaces 143 are communicated with an air port (not illustrated) in communication with the atmosphere. As illustrated in FIG. 9, the first port 141 is in communication with the air flow path 120BK through a tube 140BK and the air communication port 124 of the cartridge-attachment portion 110BK. The second port 142 is in communication with the air flow paths 120CL through a tube 140CL and the air communication port 124 for the cartridge-attachment portions 110CL. Note that, although not illustrated in the drawings, all of the three air flow paths 120CL are in communication with the second port 142.

The rotary body 139 receives driving power from a rotary body-driving motor 174 (see FIG. 8) to be rotated inside the cylinder 138. In accordance with the rotation of the rotary body 139 inside the cylinder 138, a state of the first switch mechanism 61 is switched, thereby changing the communication state of the first port 141 and the second port 142 those are provided at the upper portion of the cylinder 138 with the atmosphere. As described above, the first switch mechanism 61 is configured to be switched at least between the first state illustrated in FIG. 12C and the second state illustrated in FIG. 10C.

Figure 12A:
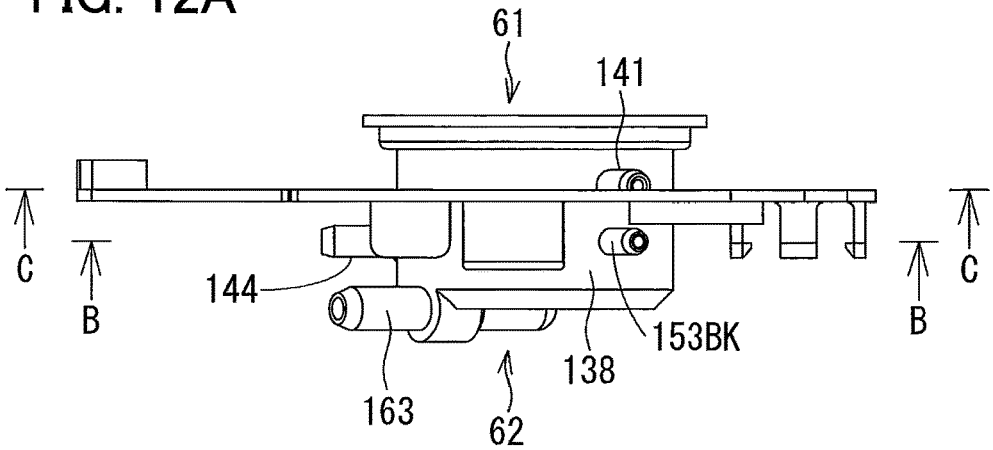
FIG. 12A is a front view illustrating a first state of the first switch mechanism 61 and a fourth state of the second switch mechanism 62.
Figure 12B:
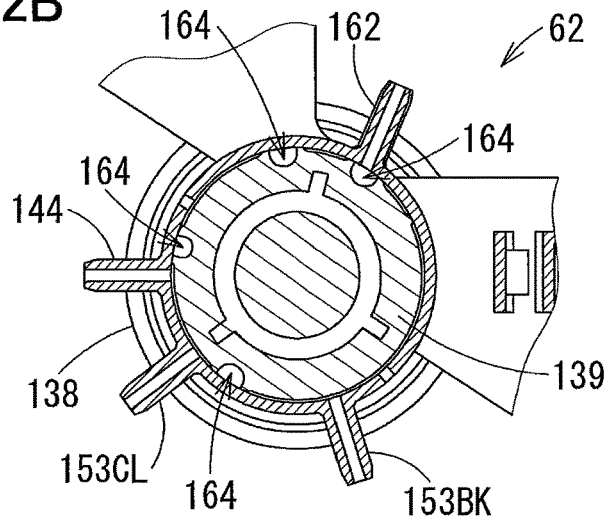
FIG. 12B is a cross-sectional view of FIG. 12A taken along a line B-B.
Figure 12C:
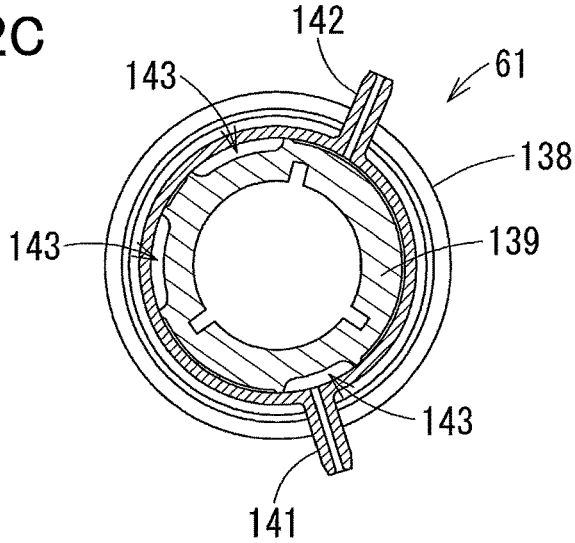
FIG. 12C is a cross-sectional view of FIG. 12A taken along a line C-C.

As illustrated in FIG. 12C, that is, in a state where the first switch mechanism 61 is in the first state, the first port 141 is in communication with the air port through the space 143, thereby communicating with the atmosphere. On the other hand, the second port 142 and the space 143 are not communicated with each other. Therefore, communication of the second port 142 with the atmosphere is interrupted. That is, in the first state of the first switch mechanism 61, the air flow path 120BK is communicated with the atmosphere, while the air flow path 120CL is not communicated with the atmosphere.

As illustrated in FIG. 10C, in a state where the first switch mechanism 61 is in the second state, the second port 142 is communicated with the air port through the space 143 to communicate with the atmosphere, whereas the first port 141 is not communicated with the space 143 and is not communicated with the atmosphere. That is, in the second state of the first switch mechanism 61, the air flow path 120CL is allowed to be communicated with the atmosphere, and the air flow path 120BK is prevented from being communicated with the atmosphere.

As described above, the rotation of the rotary body 139 causes switch of the communication state between the first port 141 and the atmosphere, and the communication state between the second port 142 and the atmosphere.

Figure 14A:
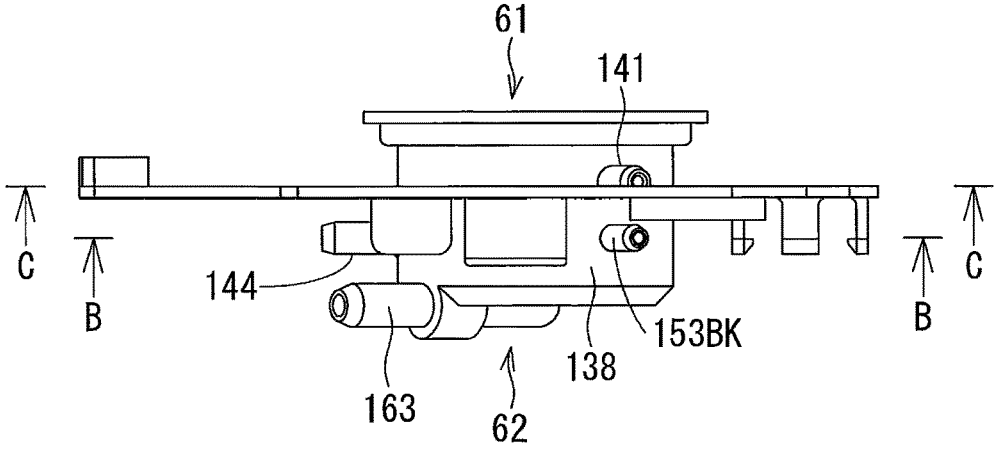
FIG. 14A is a front view of the first switch mechanism 61 and the second switch mechanism 62, and illustrating a state where an air port 144 of the second switch mechanism 62, the nozzle suction port 153BK, and the pump port 163 are in communication with one another.
Figure 14B:
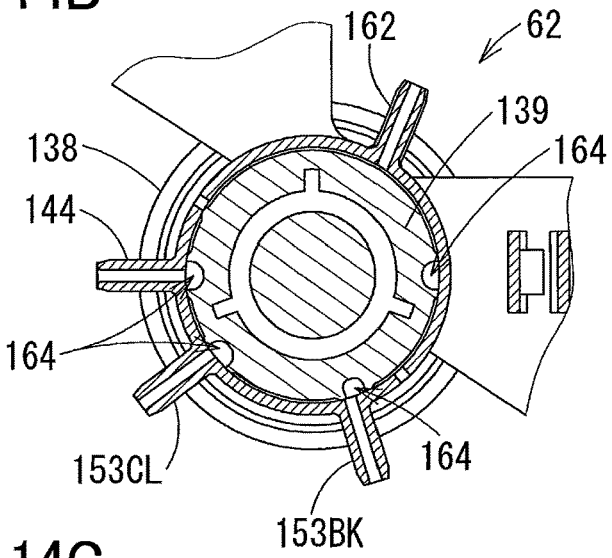
FIG. 14B is a cross-sectional view of FIG. 14A taken along a line B-B.
Figure 14C:
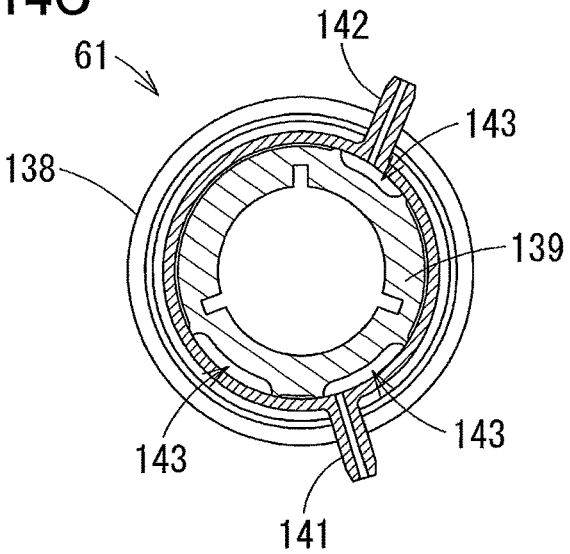
FIG. 14C is a cross-sectional view of FIG. 14A taken along a line C-C.

Incidentally, in addition to the first state and the second state, the first switch mechanism 61 can be switched to a state (see FIG. 14C) where both the first port 141 and the second port 142 are communicated with the air port through the spaces 143, and to a state (not illustrated) where neither the first port 141 nor the second port 142 is communicated with the spaces 143 (that is, neither of them is communicated with the atmosphere).

<Maintenance Mechanism 60>

Figure 15A:
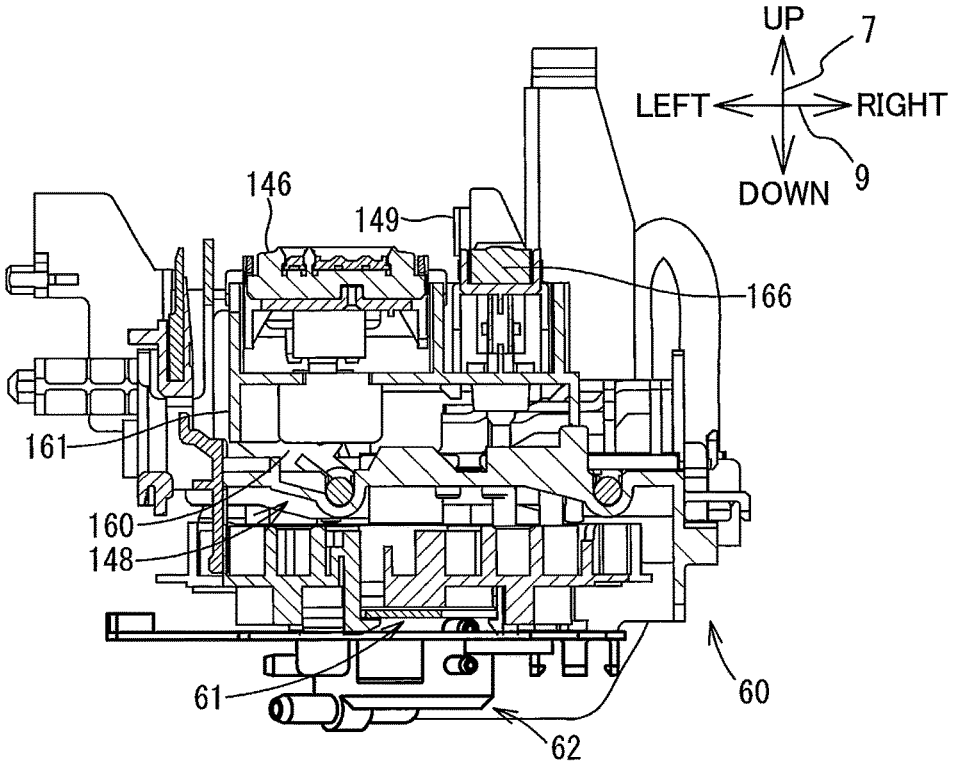
FIG. 15A is a cross-sectional view of a maintenance mechanism 60 of the multifunction peripheral 10 according to the embodiment, and illustrating an non-capping position of caps 146 and 166 of the maintenance mechanism 60.
Figure 15B:
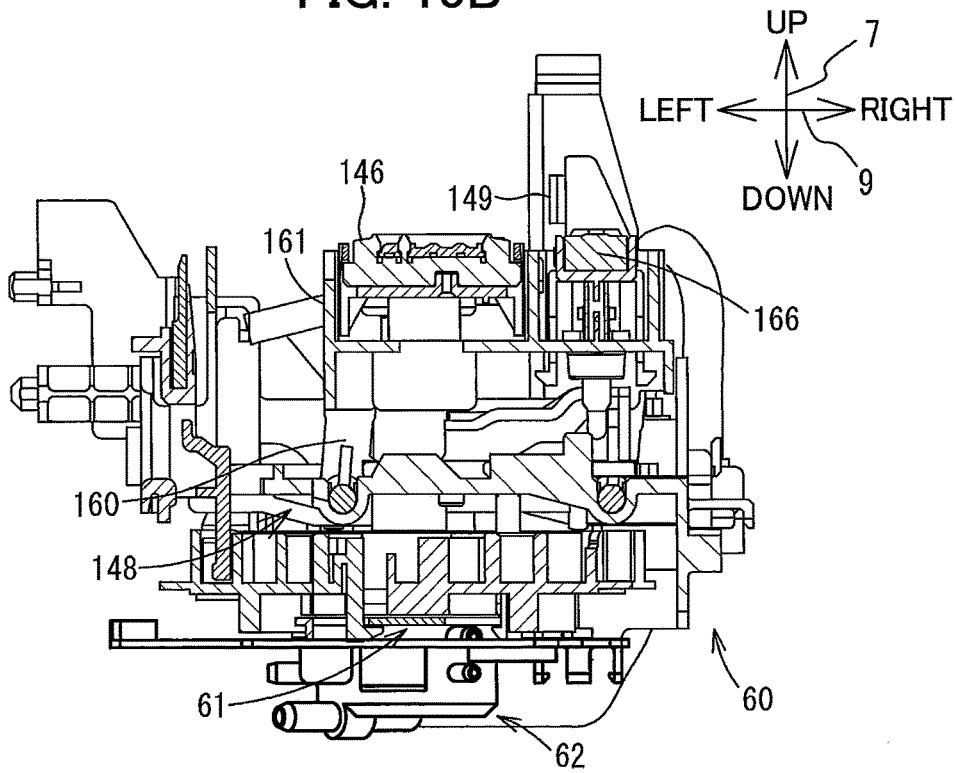
FIG. 15B is a cross-sectional view of the maintenance mechanism 60, and a capping position of the caps 146 and 166.

The multifunction peripheral 10 further includes a maintenance mechanism 60 illustrated in FIGS. 9, 15A and 15B. As illustrated in FIG. 3, the maintenance mechanism 60 is disposed at a position rightward from an area (hereinafter, referred to as "passing area") where the sheets 12 are conveyed by the pair of conveying rollers 25 and the pair of discharging rollers 27. The recording head 21 and the sheets 12 supported by the platen 26 can oppose each other in the passing area.

As illustrated in FIGS. 15A and 15B, the maintenance mechanism 60 includes caps 146 and 166, a lift-up mechanism 148, an abutment lever 149, and a pump 150 (see FIG. 9). The maintenance mechanism 60 executes a purge operation to suck ink or air in the nozzles 29 and foreign matters adhering onto a nozzle surface (hereinafter, the mentioned ink, air, and foreign matters are collectively referred to as "ink and the like"), and a so-called "idle-ejection operation" to suck the ink and the like ejected from the recording head 21 to the cap 146. The ink and the like sucked or removed by the maintenance mechanism 60 are configured to be stored in a waste liquid tank 152 (see FIG. 9).

The caps 146 and 166 are formed of rubber. The caps 146 and 166 are provided so as to face the carriage 22 when the carriage 22 has been moved to be positioned rightward of the passing area.

The caps 146 and 166 are movable between a capping position (a position illustrated in FIGS. 9 and 15B) where the caps 146 and 166 provide intimate contact with the recording head 21 and a non-capping position (a position illustrated in FIG. 15A) where the caps 146 and 166 are positioned lower than in the capping position and spaced apart from the recording head 21.

As illustrated in FIG. 9, the cap 146 includes a cap 146BK and a cap 146CL.

The cap 146BK is configured to cover a portion of the recording portion 24 in which the nozzles 29 for ejecting black ink are provided, thereby providing a sealed space between the cap 146BK and the covered portion. That is, the cap 146BK covers a portion where the nozzles 29 communicated with the damper chamber 44BK are provided. The cap 146CL is configured to cover a portion of the recording portion 24 in which the nozzles 29 configured to eject color ink are provided and to form a sealed space between the cap 146CL and the covered portion. That is, the cap 146CL covers a portion in which the nozzles 29 communicated with each damper chamber 44CL are provided.

Accordingly, the cap 146 (namely, the cap 146BK and the 146CL) is configured to cover the nozzle surface (i.e., a surface of the recording head 21 at which the nozzles 29 are formed) of the recording head 21 when the cap 146 is in the capping position. To the contrary, the cap 146 is configured to be separated from the nozzle surface when the cap 146 is in the non-capping position.

The cap 146BK is connected to a nozzle suction port 153BK of the second switch mechanism 62 through a tube 158BK. The cap 146CL is connected to a nozzle suction port 153CL of the second switch mechanism 62 through a tube 158CL.

The cap 166 is configured to cover an opening 184BK and openings 184CL (see FIG. 9) when the cap 166 is in the capping position. The cap 166 is configured to expose the opening 184BK and the openings 184CL downward when the cap 166 is in the non-capping position. The cap 166 is connected to an exhaust port 162 (described later) of the second switch mechanism 62 through a tube 147 of an exhaust unit 165 of the second switch mechanism 62.

The pump 150 illustrated in FIG. 9 is a rotary tube pump, for example. The pump 150 is driven by a pump-driving motor 176 (see FIG. 8) to provide a fluid path (ink, air, or the like) directed from a suction port 154 (see FIG. 9) toward a discharge port 156 (see FIG. 9). That is, the pump 150 is configured to discharge fluid sucked through the suction port 154 through the discharge port 156. A tube 157 extending from the suction port 154 has a distal end connected to a pump port 163 of the second switch mechanism 62. A tube 159 extending from the discharge port 156 is communicated with the waste liquid tank 152.

As illustrated in FIGS. 15A and 15B, the lift-up mechanism 148 includes a link 160. As the link 160 is pivotally moved interlocking with movement of the carriage 22, a holder 161 is movable between a position illustrated in FIG. 15A and a position illustrated in FIG. 15B. The holder 161 holds the caps 146, 166 and the abutment lever 149 protruding vertically upward. The abutment lever 149 extends up to a movable range of the carriage 22.

When the carriage 22 is moved to the position rightward of the passing area, the carriage 22 urges the abutment lever 149 to move the same rightward. The holder 161 holding the abutment lever 149 is moved upward interlocking with the rightward movement of the abutment lever 149 to move the caps 146 and 166 to the capping position. On the other hand, when the carriage 22 is moved leftward from a position rightward of the passing area, the carriage 22 separates from the abutment lever 149, whereby the abutment lever 149 is moved leftward. As a consequence, the holder 161 is moved downward interlocking with the leftward movement of the abutment lever 149 to move the caps 146 and 166 to the non-capping position.

<Second Switch Mechanism 62>

As illustrated in FIG. 9, the multifunction peripheral 10 further includes the second switch mechanism 62 (an example of a second switch). The second switch mechanism 62 is configured to be switched at least between a third state and a fourth state (described later) to switch a communication state of the damper chamber 44BK and the damper chambers 44CL with the suction port 154.

As illustrated in FIGS. 10A and 10B, the cylinder 138 and the rotary body 139 constitute the second switch mechanism 62. In other words, the second switch mechanism 62 shares the cylinder 138 and the rotary body 139 with the first switch mechanism 61. Put another way, the first movable member (i.e., the upper portion of the rotary body 139) and the second movable member (i.e., the lower portion of the rotary body 139) are integrally formed with each other. As described above, the lower portion of the cylinder 138 and the lower portion of the rotary body 139 correspond to the second switch mechanism 62.

The nozzle suction ports 153BK and 153CL, the exhaust port 162, the pump port 163 (see FIG. 10A), and an air port 144 are provided at the lower portion of the cylinder 138. Spaces 164 are formed between the lower portion of the cylinder 138 and the lower portion of the rotary body 139. Each of the spaces 164 is in communication with the pump port 163. As illustrated in FIG. 9, the nozzle suction port 153BK is communicated with the cap 146BK of the maintenance mechanism 60 through the tube 158BK, and the nozzle suction port 153CL is communicated with the cap 146CL through the tube 158CL. The exhaust port 162 is communicated with the cap 166 through the tube 147 of the exhaust unit 165. The pump port 163 is communicated with the suction port 154 of the pump 150 through the tube 157. The air port 144 is communicated with the atmosphere.

The second switch mechanism 62 includes the exhaust unit 165 (see FIG. 9). The exhaust unit 165 includes a flow path 181BK (an example of a first flow path), a flow path 181CL (an example of a second flow path), the tube 147 (an example of a third flow path), a valve 182BK (an example of a first valve), a valve 182CL (an example of a second valve), a coil spring 183BK, a coil spring 183CL, an exhaust shaft 185BK, an exhaust shaft 185CL, and a cam mechanism 187 (see FIG. 9, an example of a third movable member).

The flow path 181BK extends from the damper chamber 44BK toward the cap 166. The flow path 181BK has one end formed with the opening 184BK (an example of a first opening). The flow path 181CL extends from the damper chamber 44CL toward the cap 166. The flow path 181CL has one end formed with the opening 184CL (an example of a second opening). Each of the opening 184BK and the opening 184CL is in communication with the outside of the recording portion 24. The opening 184BK and the opening 184CL are covered by the cap 166 when the cap 166 is in the capping position.

The tube 147 has one end connected to the cap 166. In a state where the cap 166 is in the capping position, the tube 147 is communicated with the opening 184BK and the opening 184CL through the cap 166. The tube 147 has another end connected to the exhaust port 162 and communicated therewith.

The valve 182BK is disposed in the flow path 181BK. The valve 182BK is movable in the up-down direction 7 between a closing position (a position illustrated in FIG. 9) closing the opening 184BK and an opening position that is higher than the closing position to open the opening 184BK. The valve 182CL is disposed within the flow path 181CL, and is movable in the up-down direction 7 between a closing position (position illustrated in FIG. 9) closing the opening 184CL and an opening position that is higher than the closing position to open the opening 184CL.

The coil spring 183BK is disposed in the flow path 181BK and urges the valve 182BK toward its closing position. The coil spring 183CL is disposed in the flow path 181CL and urges the valve 182CL to its closing position.

The exhaust shaft 185BK is positioned below the valve 182BK. The exhaust shaft 185CL is positioned below the valve 182CL. The exhaust shafts 185BK and 185CL penetrate the cap 166. A gap provided between the exhaust shaft 185BK and the cap 166 and a gap provided between the exhaust shaft 185CL and the cap 166 are closed with, for example, rubber. With this configuration, the exhaust shaft 185BK and the cap 166 are movable in the up-down direction 7 relative to each other without generating gaps between the exhaust shaft 185BK and the cap 166. Similarly, the exhaust shaft 185CL and the cap 166 are movable in the up-down direction 7 relative to each other without generating gaps therebetween.

In the above description, only one flow path 181CL, valve 182CL, coil spring 183CL, and exhaust shaft 185CL are assumed to be provided. However, in the present embodiment, although not illustrated in the drawings, the three flow paths 181CL, the three valves 182CL, the three coil springs 183CL, and the three exhaust shafts 185CL are provided. Note that the three exhaust shafts 185CL are integrally formed so that the three exhaust shafts 185CL can be moved integrally.

The cam mechanism 187 is configured to move each of the exhaust shafts 185BK and 185CL in the up-down direction 7 so that the valve 182BK and the valve 182CL can switch open and close of the opening 184BK and the opening 184CL, respectively. The cam mechanism 187 includes a cam follower 188 and a rotary cam (not illustrated).

The cam follower 188 is slidingly movable in the left-right direction 9 in accordance with rotation of the rotary cam to move the exhaust shafts 185BK and 185CL in the up-down direction 7. An upper surface of the cam follower 188 is formed with a plurality of cam grooves (not illustrated) whose positions in the up-down direction 7 are continuously changed corresponding to the exhaust shafts 182BK and 182CL. Lower end portions of the exhaust shafts 185BK and 185CL are fitted into the corresponding cam grooves of the cam follower 188. With this configuration, the exhaust shafts 185BK and 185CL are movable in the up-down direction 7 in accordance with the sliding movement of the cam follower 188.

As the exhaust shaft 185BK is moved upward, the exhaust shaft 185BK abuts against the valve 182BK to press the same upward. As a result, the valve 182BK is moved to the opening position against the urging force of the coil spring 183BK. When the exhaust shaft 185CL is moved upward, the exhaust shaft 185CL abuts against the valve 182CL to press the same upward. As a result, the valve 182CL is moved to the opening position against the urging force of the coil spring 183CL.

The exhaust shaft 185BK is moved downward to separate from the valve 182BK, whereby the valve 182BK is moved to the closing position by the urging force of the coil spring 183BK. When the exhaust shaft 185CL is moved downward to separate from the valve 182CL, the valve 182CL is moved to the closing position due to the urging force of the coil spring 183CL.

The cam grooves of the cam follower 188 have different configurations from each other. Accordingly, the cam follower 188 can be slidingly moved to a position where the valve 182BK is in the opening position and the valve 182CL is in the closing position, a position where the valve 182BK is in the closing position and the valve 182CL is in the closing position, a position where both the valves 182BK and 182CL are in the opening position, and a position where both the valves 182BK and 182CL are in the closing position.

The rotary cam is integrally rotatable with the rotary body 139. The rotary cam has a cam groove whose diameter from a diametrical center of the rotary body 139 is continuously changed. A protrusion protruding from a lower surface of the cam follower 188 is fitted into the cam groove of the rotary cam. With this configuration, the cam follower 188 is slidingly movable in the left-right direction 9 in accordance with the rotation of the rotary cam. That is, the cam follower 188 is movable interlocking with movement (rotation) of the rotary body 139.

As the rotary body 139 receives driving power from the rotary body-driving motor 174 (see FIG. 8) to be rotated, communication states of the nozzle suction ports 153BK and 153CL, the exhaust port 162, and the air port 144 which are formed at the lower portion of the cylinder 138 with respect to the pump port 163 are changed. That is, rotation of the rotary body 139 causes a state between the exhaust port 162 and the pump port 163 to be changed. Further, as the rotary body 139 receives driving power from the rotary body-driving motor 174 to be rotated, the rotary cam is rotated together with the rotary body 139, thereby changing positions of the valves 182BK and 182CL. In relation to the changes described above, communication states between the damper chambers 44BK, 44CL and the suction port 154 is configured to be changed. As described above, the second switch mechanism 62 is configured to be switched at least between the third state illustrated in FIG. 12B and the fourth state illustrated in FIG. 10B.

As illustrated in FIG. 12B, when the second switch mechanism 62 is in the fourth state, the exhaust port 162 is communicated with the pump port 163 (see FIGS. 9 and 12A) through the space 164 to be communicated with the suction port 154 (see FIG. 9) of the pump 150. Further, at this time, the valve 182CL illustrated in FIG. 9 is in the opening position, and the valve 182BK is in the closing position. As a result, the damper chamber 44CL can be communicated with the suction port 154 through the exhaust unit 165, while the damper chamber 44BK is not communicated with the suction port 154.

As illustrated in FIG. 10B, when the second switch mechanism 62 is in the third state, the exhaust port 162 is communicated with the pump port 163 (see FIGS. 9 and 10A) through the space 164 and is communicated with the suction port 154 (see FIG. 9) of the pump 150. Further, at this time, the valve 182BK illustrated in FIG. 9 is in the opening position, and the valve 182CL is in the closing position. As a result, the damper chamber 44BK is allowed to be communicated with the suction port 154 through the exhaust unit 165, while communication between the damper chamber 44CL and the suction port 154 is interrupted.

In the fourth state of the second switch mechanism 62, the damper chamber 44CL and the suction port 154 are in communication with each other through the exhaust unit 165 (i.e., through the flow path 181CL and the tube 147) not through the nozzles 29. On the other hand, when the second switch mechanism 62 is in the third state, the damper chamber 44BK and the suction port 154 are in communication with each other through the exhaust unit 165 (i.e., through the flow path 181BK and the tube 147) but not through the nozzles 29. The flow path 181BK and the tube 147 are an example of a communication passage, and the flow path 181CL and the tube 147 are another example of a communication passage.

The ports provided at the cylinder 138 and the spaces 143, 164 of the rotary body 139 are provided at such positions that: when the first switch mechanism 61 is switched to the first state, the second switch mechanism 62 is switched to the fourth state (see FIG. 12B); and that when the first switch mechanism 61 is switched to the second state, the second switch mechanism 62 is switched to the third state (see FIG. 10B). That is, the second switch mechanism 62 is switched to the fourth state interlocking relation to the switch of the first switch mechanism 61 to the first state. Further, the second switch mechanism 62 is switched to the third state interlocking relation to the switch of the first switch mechanism 61 to the second state.

Note that, in addition to the third state and the fourth state, the second switch mechanism 62 can further be switched to a state (see FIG. 11B) where the nozzle suction port 153BK is communicated with the pump port 163 through the space 164, a state (see FIG. 13B) where the nozzle suction port 153CL is communicated with the pump port 163 through the space 164, and a state (see FIG. 14B) where the air port 144, the nozzle suction port 153BK, and the nozzle suction port 153CL are in communication with the pump port 163 through the spaces 164.

<Optical Sensor 57>

The multifunction peripheral 10 further includes an optical sensor 57 (see FIG. 8). The optical sensor 57 is configured to detect a position (rotational phase) of the rotary body 139. The rotary body 139 includes a plurality of protruding portions (not illustrated) each protruding radially outward. The plurality of protruding portions is provided at positions different in phase relative to rotation of the rotary body 139. The protruding portions are arranged spaced apart from each other by a predetermined angle of rotation of the rotary body 139.

Figure 16:
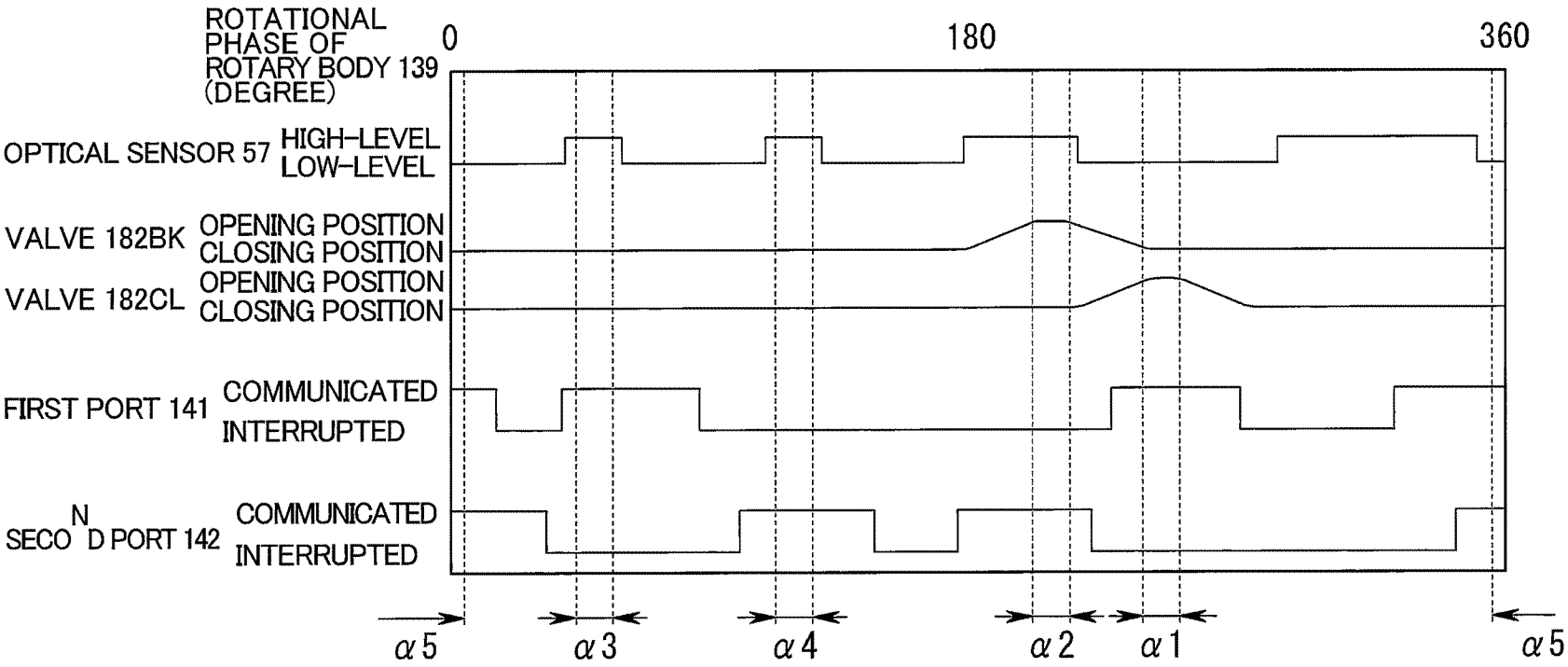
FIG. 16 is a timing chart showing a signal outputted from an optical sensor 57, communication state of the first port 141 with an atmosphere, communication state of a second port 142 with the atmosphere, a position of a valve 128BK, a position of a valve 182CL with respect to a position (rotational phase) of a rotary body 139.

The optical sensor 57 is disposed so as to face an outer periphery of the rotary body 139. When the optical sensor 57 and any one of the protruding portions oppose each other, the optical sensor 57 outputs a high-level signal to the controller 130 (see FIG. 8). On the other hand, when the optical sensor 57 and the protruding portions do not face each other, the optical sensor 57 outputs a low-level signal to the controller 130. FIG. 16 illustrates signals outputted from the optical sensor 57 corresponding to the position (rotational phase) of the rotary body 139. As a sensor for detecting the position of the rotary body 139, various well-known sensors (for example, a proximity sensor) other than the optical sensor 57 may be employed.

<Ink Cartridge 30>

Figure 7:
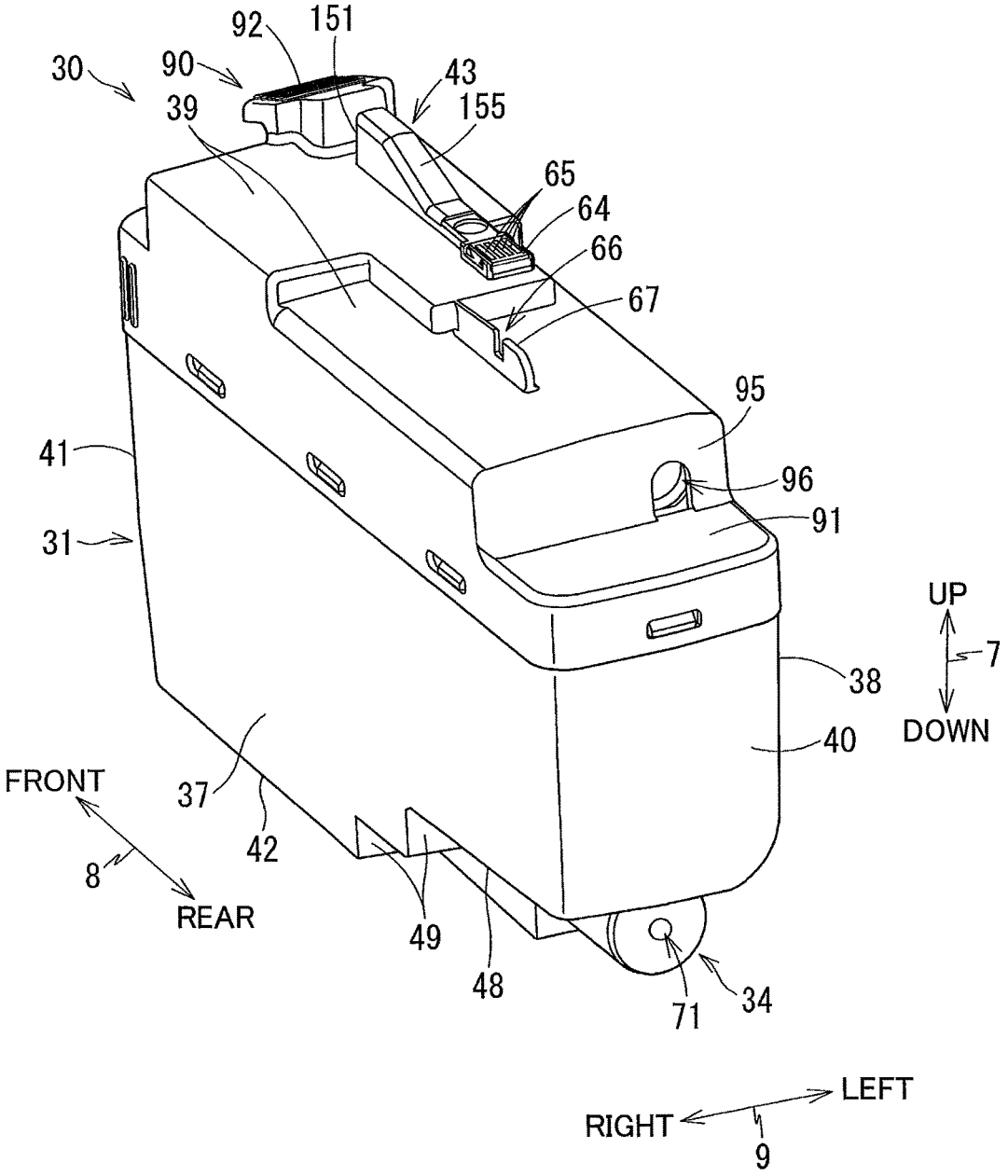
FIG. 7 is a perspective view of the ink cartridge 30 as viewed from a front side thereof.

The ink cartridge 30 illustrated in FIGS. 6 and 7 is a container for storing ink therein. The posture of the ink cartridge 30 illustrated in FIGS. 6 and 7 is an operable posture of the ink cartridge 30, that is, the posture of the ink cartridge 30 when the ink cartridge 30 is capable of being used in the multifunction peripheral 10.

As illustrated in FIGS. 6 and 7, the ink cartridge 30 includes a cartridge casing 31 that is substantially rectangular parallelepiped. As illustrated in FIG. 7, the cartridge casing 31 includes a rear wall 40, a front wall 41, a top wall 39, a bottom wall 42, a right side wall 37, and a left side wall 38.

The cartridge casing 31 as a whole has a generally flattened shape so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9. At least the front wall 41 of the cartridge casing 31 has light transmission capability so that the liquid level of the ink stored in a storage chamber 32 (described later) and the storage chamber 33 can be visually recognized from an outside of the cartridge casing 31.

The cartridge casing 31 includes a sub-bottom wall 48 positioned upward relative to the bottom wall 42 and extending frontward continuously from a lower end of the rear wall 40. In the present embodiment, a rear end of the sub-bottom wall 48 is positioned rearward relative to a rear end of the ink supply portion 34, while a front end of the sub-bottom wall 48 is positioned frontward relative to the rear end of the ink supply portion 34. A step wall 49 connects the bottom wall 42 to the sub-bottom wall 48. The ink supply portion 34 extends rearward from the step wall 49 at a position downward relative to the sub-bottom wall 48 and upward relative to the bottom wall 42. Incidentally, the rear end of the sub-bottom wall 48 may be positioned at an arbitrary position. For example, the rear end of the sub-bottom wall 48 may be positioned frontward relative to the rear end of the ink supply portion 34.

A protruding portion 43 is provided at an outer surface of the top wall 39 to protrude upward therefrom. The protruding portion 43 extends in the front-rear direction 8. The protruding portion 43 has a lock surface 151 facing frontward. The lock surface 151 is positioned upward relative to the top wall 39. The lock surface 151 is configured to contact the lock shaft 145 in a state where the ink cartridge 30 is attached to the cartridge-attachment portion 110. The lock surface 151 comes into contact with the lock shaft 145 while pushing the lock shaft 145 frontward, so that the ink cartridge 30 is held in the cartridge-attachment portion 110 against the urging forces of the coil springs 78 and 98.

The protruding portion 43 also has an inclined surface 155. The inclined surface 155 is positioned rearward relative to the lock surface 151. During an attachment process of the ink cartridge 30 to the cartridge-attachment portion 110, the lock shaft 145 is guided by the inclined surface 155. As the lock shaft 145 moves along the inclined surface 155, the lock shaft 145 is guided to a position capable of contacting the lock surface 151.

An operation portion 90 is disposed frontward relative to the lock surface 151 on the top wall 39. The operation portion 90 has an operation surface 92. When the operation surface 92 is pushed downward in a state where the ink cartridge 30 is attached to the cartridge-attachment portion 110, the ink cartridge 30 is pivotally moved, thereby moving the lock surface 151 downward. As a result, the lock surface 151 is positioned further downward relative to the lock shaft 145. In this way, the ink cartridge 30 can be extracted from the cartridge-attachment portion 110.

The light-blocking plate 67 is provided at the outer surface of the top wall 39 to protrude upward therefrom. The light-blocking plate 67 extends in the front-rear direction 8. The light-blocking plate 67 is disposed rearward relative to the protruding portion 43.

The light-blocking plate 67 is arranged to be located between the light-emitting portion and the light-receiving portion of the attachment sensor 113 in a state where the ink cartridge 30 is attached to the cartridge-attachment portion 110. Hence, the light-blocking plate 67 is configured to block the light of the attachment sensor 113 traveling in the left-right direction 9.

More specifically, when the light emitted from the light-emitting portion of the attachment sensor 113 is incident on the light-blocking plate 67 before the light arrives at the light-receiving portion of the attachment sensor 113, an intensity of the light received by the light-receiving portion is less than a predetermined intensity, for example, zero. Note that the light-blocking plate 67 may completely block the light traveling from the light-emitting portion to the light-receiving portion, or may partially attenuate the light. Alternatively, the light-blocking plate 67 may refract the light to change a traveling direction thereof, or may fully reflect the light.

In the present embodiment, a notch 66 is formed in the light-blocking plate 67. The notch 66 is a space that is recessed downward from an upper edge of the light-blocking plate 67, and extends in the front-rear direction 8. Since the notch 66 is formed in the light-blocking plate 67 at a position opposing the attachment sensor 113 in a state where the ink cartridge 30 is attached to the cartridge-attachment portion 110, the light emitted from the light-emitting portion of the attachment sensor 113 passes through the notch 66 and is therefore not blocked by the light-blocking plate 67. Accordingly, the light emitted from the light-emitting portion of the attachment sensor 113 reaches the light-receiving portion of the attachment sensor 113. On the other hand, in case that the notch 66 is not formed in the light-blocking plate 67, the light-blocking plate 67 opposes the light-emitting portion of the attachment sensor 113 in a state where the ink cartridge 30 is attached to the cartridge-attachment portion 110. Accordingly, the light emitted from the light-emitting portion of the attachment sensor 113 does not reach the light-receiving portion of the attachment sensor 113. With this configuration, types of the ink cartridges 30, such as types of ink stored in the ink cartridges 30, and initial amounts of ink stored in the ink cartridges 30, can be determined based on whether or not the notch 66 is formed in the light-blocking plate 67 of the ink cartridge 30 attached to the cartridge-attachment portion 110.

An IC board 64 is also provided at the outer surface of the top wall 39. The IC board 64 is positioned between the light-blocking plate 67 and the protruding portion 43 in the front-rear direction 8. The IC board 64 is electrically connected to the corresponding set of four contacts 106 in a state where the ink cartridge 30 is attached to the cartridge-attachment portion 110.

The IC board 64 includes a substrate made of silicon for example, an IC (not illustrated), and four electrodes 65. The IC and the four electrodes 65 are mounted on the substrate. The four electrodes 65 are arrayed in the left-right direction 9. The IC is a semiconductor integrated circuit. The IC readably stores data indicative of information on the ink cartridge 30, such as a lot number, a manufacturing date, a color of ink, and the like. Alternatively, the IC board 64 may be configured by providing the IC and electrodes on a flexible substrate having flexibility.

Each of the four electrodes 65 is electrically connected to the IC. Each of the four electrodes 65 extends in the front-rear direction 8. The electrodes 65 are arranged spaced apart from one another in the left-right direction 9. Each electrode 65 is provided on an upper surface of the IC board 64 and exposed thereon to an outside to allow electrical access to the electrode 65.

A step wall 95 facing rearward extends upward from a front end of a sub-top wall 91 that is positioned rearward relative to the top wall 39. The step wall 95 is formed with the air communication port 96 to allow the storage chamber 32 to communicate with the atmosphere. In other words, the air communication port 96 is positioned higher relative to the center of the cartridge casing 31 in the up-down direction 7. The air communication port 96 is a substantially circular-shaped opening formed in the step wall 95. The air communication port 96 has an inner diameter that is greater than an outer diameter of the rod 125 of the cartridge-attachment portion 110.

As illustrated in FIG. 6, in the attachment process of the ink cartridge 30 into the cartridge-attachment portion 110, the rod 125 enters an air valve chamber 36 (described later) through the air communication port 96. As the rod 125 passes through the air communication port 96, the rod 125 moves a valve 97 configured to seal the air communication port 96 frontward against the urging force of the coil spring 98. As the valve 97 is moved frontward to be separated from the air communication port 96, the storage chamber 32 is open to the atmosphere.

Incidentally, a member for sealing the air communication port 96 should not necessarily be the valve 97. For example, a peel-off seal may be provided at the step wall 95 to seal the air communication port 96.

As illustrated in FIG. 6, the cartridge casing 31 is formed with the storage chamber 32, the storage chamber 33, the ink valve chamber 35, and the air valve chamber 36. Each of the storage chamber 32, the storage chamber 33, and the ink valve chamber 35 is configured to store ink therein. The storage chamber 32, the storage chamber 33, and the ink valve chamber 35 are an example of a first storage space and a second storage space. The air valve chamber 36 is configured to allow air to pass therethrough. The air valve chamber 36 is an example of a first air passage and a second air passage. The storage chamber 32 and the storage chamber 33 are in communication with each other through a through-hole (not illustrated). The storage chamber 32 and the air valve chamber 36 are in communication with each other through a through-hole 46. The storage chamber 33 and the ink valve chamber 35 are in communication with each other through a through-hole 99 formed at a lower end portion of the storage chamber 33.

Within the air valve chamber 36, the valve 97 and the coil spring 98 are accommodated. The air valve chamber 36 is in communication with the outside through the air communication port 96. The valve 97 is movable between a closed position and an open position. At the closed position, the valve 97 seals the air communication port 96. At the open position, the valve 97 is separated from the air communication port 96. The coil spring 98 is disposed in the air valve chamber 36 so as to be capable of expanding and contracting in the front-rear direction 8. The coil spring 98 urges the valve 97 rearward, i.e., in a direction such that the valve 97 contacts the air communication port 96. The coil spring 98 has a spring constant that is smaller than a spring constant of the coil spring 78 of the ink supply portion 34.

A wall 93 partitioning the air valve chamber 36 is formed with a through-hole 94. The through-hole 94 is sealed with a semi-permeable membrane 80.

In the present embodiment, passage resistance of an air flow path configured to allow communication of the storage chamber 32 of the ink cartridge 30 with the atmosphere (i.e., the air valve chamber 36) is smaller than passage resistance of an air flow path configured to allow communication of the storage chamber 121 of each tank 103 with the atmosphere (i.e., the air flow path 120).

Conceivably, passage resistance can be made smaller by enlarging a cross-sectional area of a passage. Also, passage resistance can be increased by making a length of a passage longer, for example. Alternatively, passage resistance can be made either smaller or larger by changing types of a semi-permeable membrane that seals a passage. Still alternatively, passage resistance can become larger by increasing a number of semi-permeable membranes that may be provided in a passage.

Note that the passage resistance of the air flow path configured to allow communication of the storage chamber 32 of the ink cartridge 30 with the atmosphere may be equal to or greater than passage resistance of the air flow path configured to allow communication of the storage chamber 121 of each tank 103 with the atmosphere.

The ink supply portion 34 protrudes rearward from the step wall 49. The ink supply portion 34 has a cylindrical outer shape. The ink supply portion 34 has an inner space serving as the ink valve chamber 35. The ink supply portion 34 has a rear end portion that is open to the outside of the ink cartridge 30 through the ink supply port 71. A seal member 76 is provided at the rear end portion of the ink supply portion 34. The ink supply portion 34 has a front end that is in communication with the lower end portion of the storage chamber 33 through the through-hole 99 as described above. That is, the ink supply portion 34 is in communication with the lower end portion of the storage chamber 33.

A valve 77 and the coil spring 78 are accommodated in the ink valve chamber 35. The valve 77 is configured to move in the front-rear direction 8 to open and close the ink supply port 71 penetrating a center portion of the seal member 76. The coil spring 78 urges the valve 77 rearward. Accordingly, the valve 77 closes off the ink supply port 71 formed in the seal member 76 in a state where no external force is applied to the valve 77.

The seal member 76 is a disk-shaped member having a center portion formed with a through-hole. The seal member 76 is made of an elastic material such as rubber or elastomer, for example. A cylindrical inner peripheral surface defining the through-hole penetrating the center portion of the seal member 76 in the front-rear direction 8 defines the ink supply port 71. The ink supply port 71 has an inner diameter slightly smaller than an outer diameter of the ink needle 102.

As the ink cartridge 30 is attached to the cartridge-attachment portion 110 in a state where the valve 77 closes off the ink supply port 71 and the valve 114 closes the opening 116 of the ink needle 102, the ink needle 102 enters into the ink supply port 71 in the front-rear direction 8. That is, the connecting portion 107 and the ink supply portion 34 are connected to each other. At this time, the outer peripheral surface of the ink needle 102 provides liquid-tight contact with the inner peripheral surface of the seal member 76 that defines the ink supply port 71, while elastically deforming the seal member 76. As the tip end of the ink needle 102 passes through the seal member 76 and advances into the ink valve chamber 35, the tip end of the ink needle 102 abuts on the valve 77. As the ink cartridge 30 is further inserted into the cartridge-attachment portion 110, the ink needle 102 moves the valve 77 frontward against the urging force of the coil spring 78, thereby opening the ink supply port 71.

While the tip end of the ink needle 102 abuts on the valve 77, the valve 77 abuts on the valve 114 from a front side thereof and pushes the valve 114 rearward. Hence, the valve 114 moves rearward against the urging force of the coil spring 115, thereby opening the opening 116 of the ink needle 102. As a result, the ink stored in the storage chamber 32, the storage chamber 33 and the ink valve chamber 35 is allowed to flow into the storage chamber 121 of the corresponding tank 103 through the internal space 117 of the ink needle 102. Here, each of the storage chamber 32, the storage chamber 33, the ink valve chamber 35 and the storage chamber 121 is open to the atmosphere. Accordingly, the ink stored in the storage chamber 32, the storage chamber 33 and the ink valve chamber 35 of the ink cartridge 30 is supplied to the storage chamber 121 of the corresponding tank 103 through the ink supply portion 34 due to hydraulic head difference.

<Controller 130>

Next, an overall configuration of the controller 130 will be described with reference to FIG. 8.

The multifunction peripheral 10 includes the controller 130. The controller 130 is configured to control overall operations of the multifunction peripheral 10. The controller 130 includes a CPU 131, a ROM 132, a RAM 133, an EEPROM 134, an ASIC 135, and an internal bus 137 that connects these components to one another.

The ROM 132 stores programs and the like with which the CPU 131 controls various operations including an image-recording control operation. The RAM 133 is used as a storage area for temporarily storing data, signals, and the like used when the CPU 131 executes the programs. The EEPROM 134 stores settings, flags, and the like that need to be preserved after the multifunction peripheral 10 is turned off The conveying motor 171, the feeding motor 172, the carriage-driving motor 173, the rotary body-driving motor 174 for rotating the rotary body 139, and the pump-driving motor 176 for driving the pump 150 are connected to the ASIC 135. The ASIC 135 includes drive circuits for controlling these motors. When the CPU 131 inputs a drive signal for rotating each motor into a corresponding drive circuit thereof, a drive current corresponding to the drive signal is configured to be outputted from the drive circuit to the corresponding motor, thereby rotating the motor. In other words, the controller 130 is configured to control the motors 171, 172, 173, 174, and 176. That is, the controller 130 is configured to control the rotary body-driving motor 174 to switch the states of the first switch mechanism 61 and the second switch mechanism 62. Further, the controller 130 is configured to control the pump-driving motor 176 to drive the pump 150.

Further, signals outputted from the attachment sensors 113 are inputted into the ASIC 135. When a low-level signal is inputted from each attachment sensor 113, the controller 130 determines that the ink cartridge 30 has been attached to the cartridge-attachment portion 110. On the other hand, when a high-level signal is inputted from each attachment sensor 113, the controller 130 determines that the ink cartridge 30 has not been attached to the cartridge-attachment portion 110.

Further, piezoelectric elements 45 are also connected to the ASIC 135. The piezoelectric elements 45 are configured to operate upon receipt of electric power supplied by the controller 130 through a drive circuit (not illustrated). The controller 130 controls supply of electric power to the piezoelectric elements 45, thereby allowing ink droplets to be selectively ejected through the plurality of nozzles 29.

Further, a signal outputted from the optical sensor 57 is also inputted into the ASIC 135. The controller 130 is configured to receive the signal outputted from the optical sensor 57 (a high-level signal or a low-level signal) so that the controller 130 can determine the rotational phase of the rotary body 139. Based on the rotational phase of the rotary body 139, the states of the first switch mechanism 61 and the second switch mechanism 62 can be determined.

FIG. 16 illustrates the signal outputted from the optical sensor 57, the communication state of the first port 141 with the atmosphere, the communication state of the second port 142 with the atmosphere, the position of the valve 182BK, and the position of the valve 182CL, those are configured to be changed depending on rotational positions $\alpha 1$ through $\alpha 5$ (rotational phases) of the rotary body 139 according to the present embodiment.

When the rotary body 139 is in the rotational position $\alpha 1$ illustrated in FIG. 16, the first port 141 is communicated with the atmosphere, and the communication of the second port 142 with the atmosphere is interrupted (see FIG. 12C). That is, when the rotary body 139 is in the rotational position $\alpha 1$, the first switch mechanism 61 is in the first state. Further, when the rotary body 139 is in the rotational position $\alpha 1$, the valve 182BK is in the closing position, while each valve 182CL is in the opening position. Further, as illustrated in FIG. 12B, when the rotary body 139 is in the rotational position al, the exhaust port 162 is communicated with the pump port 163 (see FIGS. 9 and 12A) through the space 164, and is allowed to be communicated with the suction port 154 (see FIG. 9) of the pump 150. That is, in the rotational position $\alpha 1$ of the rotary body 139, the second switch mechanism 62 is in the fourth state.

When the rotary body 139 is in the rotational position $\alpha 2$ illustrated in FIG. 16, the first port 141 is prevented from being communicated with the atmosphere, while the second port 142 is allowed to be communicated with the atmosphere (see FIG. 10C). That is, when the rotary body 139 is in the rotational position $\alpha 2$, the first switch mechanism 61 is in the second state. Further, at this time, the valve 182BK is in the opening position, and each valve 182CL is in the closing position. As illustrated in FIG. 10B, when the rotary body 139 is in the rotational position $\alpha 2$, the exhaust port 162 is communicated with the pump port 163 (see FIGS. 9 and 10A) through the space 164 to be communicated with the suction port 154 (see FIG. 9) of the pump 150. That is, when the rotary body 139 is in the rotational position $\alpha 2$, the second switch mechanism 62 is in the third state.

Figure 13A:
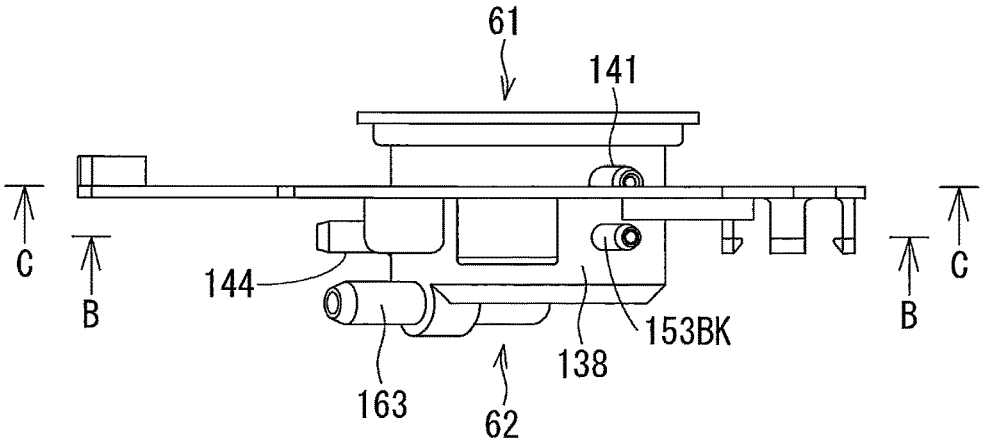
FIG. 13A is a front view of the first switch mechanism 61 and the second switch mechanism 62, and illustrating a state where a nozzle suction port 153CL of the second switch mechanism 62 is in communication with the pump port 163.
Figure 13B:
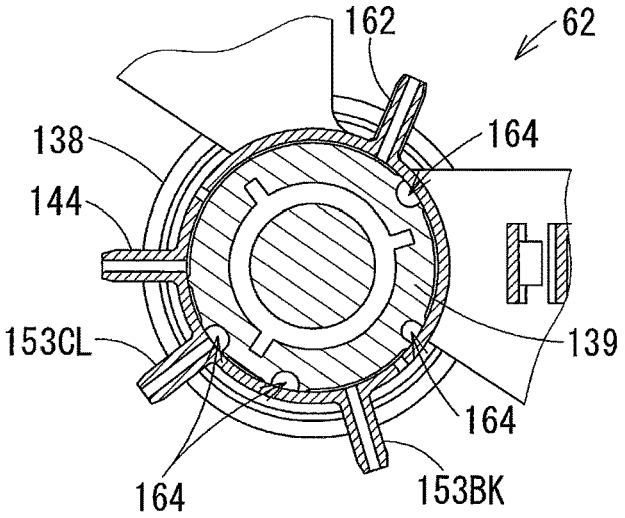
FIG. 13B is a cross-sectional view of FIG. 13A taken along a line B-B.

When the rotary body 139 is in the rotational position $\alpha 3$ illustrated in FIG. 16, as illustrated in FIG. 13B, the nozzle suction port 153CL is communicated with the pump port 163 (see FIGS. 9 and 13A) through the space 164 and is communicated with the suction port 154 (see FIG. 9) of the pump 150. Both the valve 182BK and the valve 182CL illustrated in FIG. 9 are in the closing position.

Figure 11A:
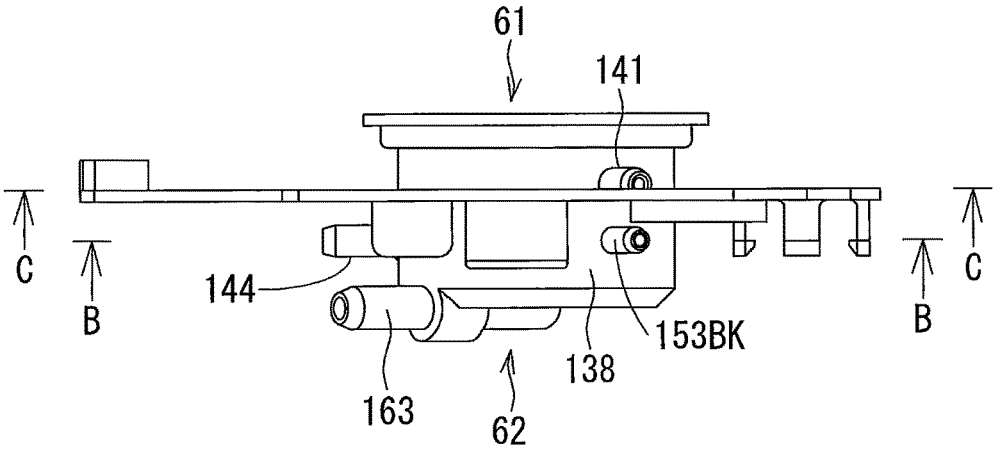
FIG. 11A is a front view of the first switch mechanism 61 and the second switch mechanism 62, and illustrating a state where a nozzle suction port 153BK of the second switch mechanism 62 is in communication with a pump port 163.
Figure 11B:
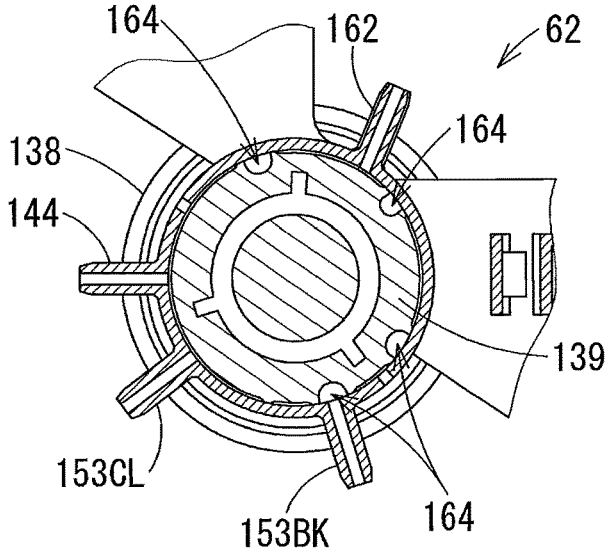
FIG. 11B is a cross-sectional view of FIG. 11A taken along a line B-B.
Figure 11C:
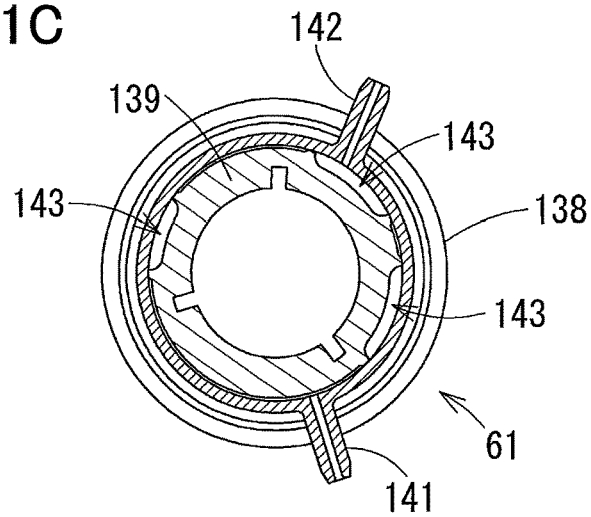
FIG. 11C is a cross-sectional view of FIG. 11A taken along a line C-C.

When the rotary body 139 is in the rotational position α4 illustrated in FIG. 16, the nozzle suction port 153BK is communicated with the pump port 163 (see FIGS. 9 and 11A) through the space 164 to be communicated with the suction port 154 (see FIG. 9) of the pump 150, as illustrated in FIG. 11B. At this time, both the valve 182BK and the valve 182CL illustrated in FIG. 9 are in the closing position.

When the of the rotary body 139 is in the rotational position α5 illustrated in FIG. 16, the air port 144, the nozzle suction port 153BK, and the nozzle suction port 153CL are in communication with the pump port 163 (see FIGS. 9 and 14A) through the spaces 164. That is, the air port 144, the nozzle suction port 153BK, and the nozzle suction port 153CL are in communication with the suction port 154 (see FIG. 9) of the pump 150. Both the valve 182BK and the valve 182CL illustrated in FIG. 9 are in the closing position.

<Initial Ink Introduction Process>

Hereinafter, an initial ink introduction process will be described while referring to FIG. 17. After the ink cartridges 30 have been attached to the cartridge-attachment portion 110BK and the cartridge-attachment portion 110CL, the controller 130 executes the initial ink introduction process to initially supply ink from the ink cartridges 30 to: the storage chamber 121BK of the cartridge-attachment portion 110BK in which ink has not been stored; and to the storage chamber 121CL of the cartridge-attachment portion 110CL in which ink has not been stored. Strictly speaking, a little amount of ink may remain in the storage chamber 121BK and the storage chamber 121CL due to the before-shipment test performed in a manufacturing company where test printing is performed by attaching an ink cartridge to a new multi-function peripheral to be shipped. The following description ignores such a little amount of ink that may remain in the storage chamber 121BK and the storage chamber 121CL, and treats the storage chamber 121BK and the storage chamber 121CL as being empty, i.e., ink as having not been stored in the storage chamber 121BK and the storage chamber 121CL.

In the following description, only one tank 103BK and only one tank 103CL are assumed to be provided. However, the number of the tank 103BK and the tank 103CL are arbitrary. For example, as described above, one tank 103BK and three tanks 103CL are provided in the present embodiment.

The controller 130 starts executing the initial ink introduction process after completion of attachment of the ink cartridges 30 to the cartridge-attachment portion 110BK and the cartridge-attachment portion 110CL, i.e., in a state where the attachment sensor 113BK and the attachment sensor 113CL output low-level signals to the controller 130. Note that, the ink cartridges 30 are open to the atmosphere in a state where the ink cartridges 30 are attached to the cartridge-attachment portion 110BK and the cartridge-attachment portion 110CL, respectively.

Figure 17:
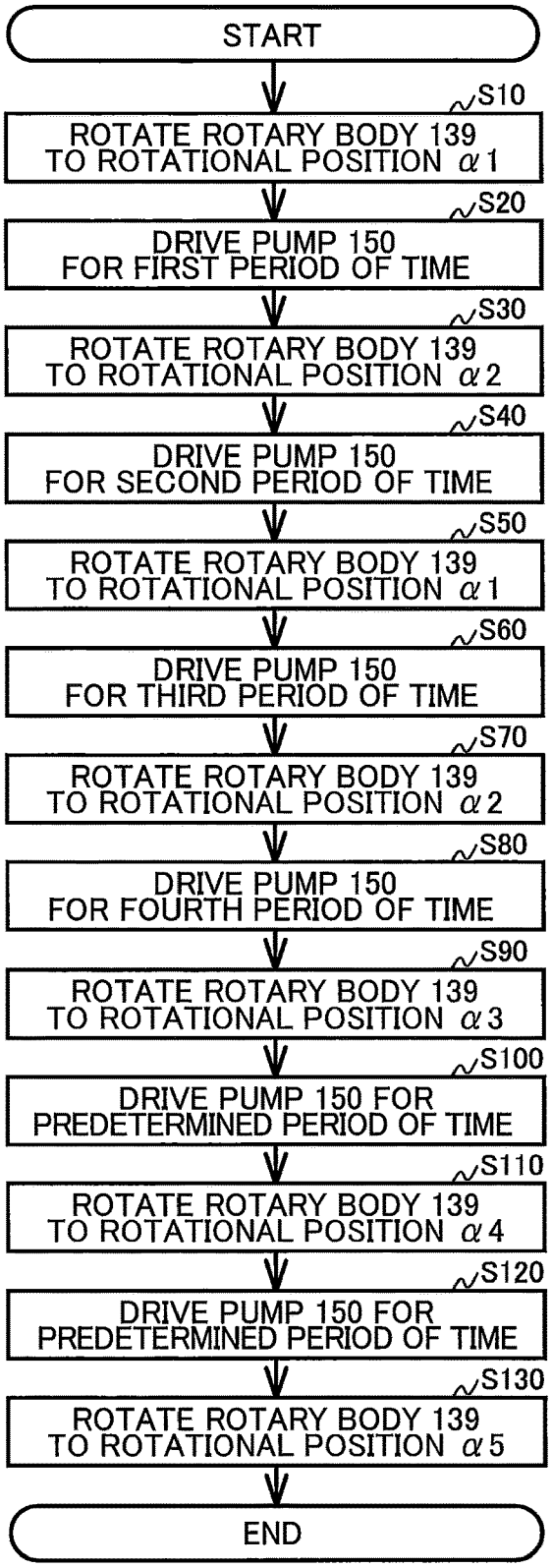
FIG. 17 is a flowchart illustrating steps in an initial ink introduction process executed by the controller 130.

In S10 at the beginning of the initial ink introduction process in FIG. 17, the controller 130 drives the rotary body-driving motor 174, thereby rotating the rotary body 139 to the rotational position al. As a result, the first switch mechanism 61 is switched to the first state, and the second switch mechanism 62 is switched to the fourth state.

When the first switch mechanism 61 is in the first state, the storage chamber 121BK is allowed to be communicated with the atmosphere through the air flow path 120BK, while communication between the storage chamber 121CL and the atmosphere through the air flow path 120CL is interrupted. Accordingly, supply of ink stored in the ink cartridge 30 to the storage chamber 121BK is started due to hydraulic head difference. Ink supplied from the ink cartridge 30 to the storage chamber 121BK is configured to be supplied toward the damper chamber 44BK through the communication port 128BK and the corresponding ink tube 20. However, since the storage chamber 121CL is prevented from communicating with the atmosphere through the air flow path 120CL, ink stored in the ink cartridge 30 attached to the cartridge-attachment portion 110CL is prevented from being supplied toward the storage chamber 121CL.

In the fourth state of the second switch mechanism 62, the storage chamber 121CL is communicated with the pump 150 (the suction port 154) through the damper chamber 44CL and the exhaust unit 165, while communication between the storage chamber 121BK and the pump 150 through the damper chamber 44BK and the exhaust unit 165 is interrupted.

Then, in S20 the controller 130 controls the pump-driving motor 176 to drive the pump 150 for a first period of time. Accordingly, fluid in the damper chamber 44CL of the carriage 22, the storage chamber 121CL of the tank 103CL, and the ink cartridge 30 attached to the cartridge-attachment portion 110CL those are communicated with the pump 150 is sucked toward the pump 150. As a result, ink stored in the ink cartridge 30 attached to the cartridge-attachment portion 110CL is supplied to the storage chamber 121CL. The ink supplied from the ink cartridge 30 to the storage chamber 121CL is then supplied toward the damper chamber 44CL through the communication port 128CL and the ink tube 20. After the first period of time has elapsed, the driving of pump 150 is stopped to interrupt supply of ink.

Note that, when the liquid level of ink stored in the storage chamber 121CL reaches the same height as an upper end of the communication port 128CL in the up-down direction 7 in S20, the communication port 128CL is closed with the ink. Accordingly, the ink supplied from the ink cartridge 30 starts flowing out of the storage chamber 121CL through the communication port 128CL. Here, since an amount of ink that the pump 150 can suck is constant, an amount of ink sucked from the ink cartridge 30 by the pump 150 and an amount of ink flowing out through the communication port 128CL by the pump 150 is approximately the same. Thus, the ink sucked from the ink cartridge 30 to the storage chamber 121CL after the liquid level of the ink in the storage chamber 121CL has become equal to or higher than the upper end of the communication port 128CL is all sucked toward the damper chamber 44CL through the communication port 128CL the ink tube 20. That is, during drive of the pump 150, the liquid level of the ink stored in the storage chamber 121CL cannot to be higher than the upper end of the communication port 128CL.

On the other hand, in the process of S10, ink is supplied from the ink cartridge 30 to the storage chamber 121BK due to hydraulic head difference. At this time, the liquid level of the ink stored in the storage chamber 121BK can be higher than an upper end of the communication port 128BK.

The first period of time is predetermined such that, the drive of the pump 150 for the first period of time allows the liquid level of the ink stored in the storage chamber 121CL to reach the same height as the upper end of the communication port 128CL in the up-down direction 7.

Subsequently, in S30 the controller 130 drives the rotary body-driving motor 174 to rotate the rotary body 139 to the rotational position α2. As a result, the first switch mechanism 61 is switched to the second state, while the second switch mechanism 62 is switched to the third state.

When the first switch mechanism 61 is in the second state, the storage chamber 121CL is communicated with the atmosphere through the air flow path 120CL, while communication between the storage chamber 121BK and the atmosphere through the air flow path 120BK is interrupted. Accordingly, ink stored in the ink cartridge 30 attached to the cartridge-attachment portion 110CL to the storage chamber 121CL starts to be supplied due to hydraulic head difference. The ink supplied from the ink cartridge 30 to the storage chamber 121CL and is configured to be subsequently supplied toward the damper chamber 44CL through the communication port 128CL and the ink tube 20. On the other hand, since communication between the storage chamber 121BK and the atmosphere through the air flow path 120BK is prevented, the ink stored in the ink cartridge 30 attached to the cartridge-attachment portion 110BK is not supplied to the storage chamber 121BK.

When the second switch mechanism 62 is in the third state, the storage chamber 121BK is communicated with the pump 150 (the suction port 154) through the damper chamber 44BK and the exhaust unit 165, whereas communication between the storage chamber 121CL and the pump 150 through the damper chamber 44CL and the exhaust unit 165 is interrupted.

In S40 the controller 130 controls the pump-driving motor 176 to drive the pump 150 for a second period of time. As a result, fluid in the damper chamber 44BK formed in the carriage 22, the storage chamber 121BK of the tank 103BK, and the ink cartridge 30 attached to the cartridge-attachment portion 110BK those are communicated with the pump 150 is sucked toward the pump 150. This operation causes the ink stored in the ink cartridge 30 to be supplied to the storage chamber 121BK. The ink supplied from the ink cartridge 30 to the storage chamber 121BK is then supplied to the damper chamber 44BK through the communication port 128BK and the ink tube 20. After the second period of time has elapsed, the driving of the pump 150 is stopped to cause the supply of ink to be stopped.

In a case where the liquid level of the ink stored in the storage chamber 121BK does not reach the same height as the upper end of the communication port 128BK during the process in S20 and S30 and when the liquid level of the ink stored in the storage chamber 121BK reaches the same height as the upper end of the communication port 128BK in the up-down direction 7 in S40, the communication port 128BK is closed with the ink. In this case, the ink supplied from the ink cartridge 30 starts flowing out of the storage chamber 121BK through the communication port 128BK. Here, since an amount of ink that the pump 150 can suck is constant, an amount of ink sucked from the ink cartridge 30 by the pump 150 and an amount of ink flowing out through the communication port 128BK by the pump 150 is approximately the same. Thus, the ink sucked from the ink cartridge 30 to the storage chamber 121BK after the liquid level of the ink in the storage chamber 121BK has become equal to or higher than the upper end of the communication port 128BK is all supplied to the damper chamber 44BK through the communication port 128BK and the ink tube 20. That is, during driving of the pump 150 in S40, the liquid level of the ink stored in the storage chamber 121BK cannot to be higher than the upper end of the communication port 128BK.

Note that, in case that the liquid level of the ink stored in the storage chamber 121 becomes higher than or equal to the upper end of the communication port 128BK during the process in S20 and S30, the liquid level of the ink has already reached the upper end of the communication port 128BK at a time of execution of S40. In the latter case, the liquid level of the ink is maintained at the same position throughout the process in S40.

On the other hand, as the ink is supplied from the ink cartridge 30 to the storage chamber 121CL due to hydraulic head difference in S30, the liquid level of the ink stored in the storage chamber 121CL can be higher than the upper end of the communication port 128CL. Since the liquid level of the ink in the storage chamber 121CL becomes the same height as the upper end of the communication port 128CL at a time of the execution of S20, in S40 the liquid level of the ink in the storage chamber 121CL becomes higher than the upper end of the communication port 128CL in the present embodiment.

A certain amount of ink is supplied from the ink cartridge 30 to the storage chamber 121CL due to hydraulic head difference from the start of execution of the process in S30 until the process in S40 is completed (i.e., until the driving of the pump 150 for the second period of time is stopped). The amount of ink supplied to the storage chamber 121CL during the process in S30 and S40 can be made large or small by setting the second period of time longer or shorter. In the present embodiment, as the rotary body 139 is rotated to the rotational position $\alpha 1$ in S30 and the pump 150 is driven for the second period of time in S40, an amount of ink supplied to the storage chamber 121CL during the process S30 and S40 due to hydraulic head difference is greater than a total amount of ink that flows out through the communication port 128CL due to suction of the pump 150 before process in S120 (described later) is completed. That is, an amount of ink stored in the storage chamber 121CL at a position above the upper end of the communication port 128CL when the process in S40 is completed is greater than an amount of ink that flows out from the storage chamber 121CL before the process in S120 is completed.

The process in S20 through S40 are an example of a first drive process.

Then in S50, the controller 130 controls the rotary body-driving motor 174 to drive to rotate the rotary body 139 to the rotational position $\alpha 1$ again. This rotation causes the first switch mechanism 61 to be switched to the first state and the second switch mechanism 62 to be switched to the fourth state, as similar to the process in S10. As a result, ink is supplied from the ink cartridge 30 to the storage chamber 121BK due to hydraulic head difference.

In S60, the controller 130 then controls the pump-driving motor 176 to drive the pump 150 for a third period of time. Through the process, the fluid in the damper chamber 44CL formed in the carriage 22, the storage chamber 121CL of the tank 103CL, and the ink cartridge 30 attached to the cartridge-attachment portion 110CL those are communicated with the pump 150 are sucked toward the pump 150. As a result, ink is supplied from the ink cartridge 30 toward the storage chamber 121CL and is further supplied to the damper chamber 44CL through the communication port 128CL and the ink tube 20. Note that the liquid level of the ink stored in the storage chamber 121CL does not rise during the process in S60. After the third period of time has elapsed, the driving of the pump 150 is stopped to thereby interrupt the supply of ink into the storage chamber 121.

Here, the third period of time is a time duration that is greater than the first period of time. Further, an amount of ink supplied from the ink cartridge 30 to the storage chamber 121BK due to hydraulic head difference from the process in S10 is started until the driving of the pump 150 for the third period of time is completed (i.e., an amount of ink that is supplied to the storage chamber 121BK due to hydraulic head difference during the process of S10, S20, S50, and S60) is greater than an amount of ink that flows out through the communication port 128BK due to driving of the pump 150 until the process in S120 is completed. That is, an amount of ink stored in the storage chamber 121BK at a position above the communication port 128BK at a time of completion of the process in S60 is greater than an amount of ink that flows out from the storage chamber 121BK until the process in S120 is completed.

As the pump 150 is driven for the third period of time, the damper chamber 44CL and the ink tube 20 connecting the damper chamber 44CL to the storage chamber 121CL are filled with ink that has been stored in the storage chamber 121CL before the process in S60 is executed.

Then in S70, the controller 130 drives the rotary body-driving motor 174 to rotate the rotary body 139 to the rotational position α2 again. As a result, as similar to the process in S30, the first switch mechanism 61 is switched to the second state, and the second switch mechanism 62 is switched to the third state. Accordingly, ink is supplied from the ink cartridge 30 to the storage chamber 121CL due to hydraulic head difference.

Subsequently, in S80 the controller 130 controls the pump-driving motor 176 to drive the pump 150 for a fourth period of time. As a result, fluid in the damper chamber 44BK provided in the carriage 22, the storage chamber 121BK of the tank 103BK, and the ink cartridge 30 attached to the cartridge-attachment portion 110BK those are communicated with the pump 150 is sucked toward the pump 150. In this way, ink is supplied from the ink cartridge 30 to the storage chamber 121BK, and is then supplied from the storage chamber 121BK toward the damper chamber 44BK through the ink tube 20. Note that, during the process in S80, the liquid level of the ink in the storage chamber 121BK does not rise. After the fourth period of time has elapsed, the driving of the pump 150 is stopped, thereby stopping the supply of ink.

The fourth period of time is a time duration that is greater than the second period of time.

As the pump 150 is driven for the fourth period of time, both the damper chamber 44BK and the ink tube 20 configured to communicate the damper chamber 44BK with the storage chamber 121BK are filled with ink that has been stored in the storage chamber 121BK before the process in S80 is executed.

The process in S50 through S80 are an example of a third drive process.

Further, in S90 the controller 130 drives the rotary body-driving motor 174 to rotate the rotary body 139 to the rotational position α3. As a result, the nozzle suction port 153CL comes into communication with the suction port 154 of the pump 150, and both the valve 182BK and the valve 182CL are placed in the closing position. Therefore, the damper chamber 44CL is communicated with the suction port 154 through the plurality of nozzles 29 and the nozzle suction port 153CL, while communication of the damper chamber 44BK with the suction port 154 is interrupted.

Then in S100, the controller 130 controls the pump-driving motor 176 to drive the pump 150 for a predetermined period of time. Accordingly, fluid in the damper chamber 44CL provided in the carriage 22, the storage chamber 121CL provided in the tank 103CL, and the ink cartridge 30 attached to the cartridge-attachment portion 110CL those are communicated with the pump 150 is sucked toward the pump 150. Through the drive of the pump 150 for a predetermined period of time, the controller 130 the recording head 21 to perform the so-called "idle-ejection operation". That is, the ink stored in the damper chamber 44CL is idly ejected through the plurality of nozzles 29 of the recording head 21, and the ink ejected from the damper chamber 44CL in the process in S100 is then discharged to the waste liquid tank 152 through the pump 150. Accordingly, the damper chamber 44CL of the carriage 22 is ready for the printing operation.

In S110 the controller 130 drives the rotary body-driving motor 174 to rotate the rotary body 139 to the rotational position α4. As a result, the nozzle suction port 153BK is in communication with the suction port 154 of the pump 150, and both the valve 182BK and the valve 182CL are in the closing position. Therefore, the damper chamber 44BK is communicated with the suction port 154 through the plurality of nozzles 29 and the nozzle suction port 153BK, while communication of the damper chamber 44CL with the suction port 154 is interrupted.

Then in S120 the controller 130 controls the pump-driving motor 176 to drive the pump 150 for a predetermined period of time. With this driving, fluid in the damper chamber 44BK of the carriage 22, the storage chamber 121BK in the tank 103BK, and the ink cartridge 30 attached to the cartridge-attachment portion 110BK which are communicated with the pump 150 is sucked toward the pump 150. As the pump 150 is driven for the predetermined period of time, the controller 130 controls the recording head 21 to perform the "idle-ejection operation" for the damper chamber 44BK. That is, the ink stored in the damper chamber 44BK is idly ejected through the nozzles 29 of the recording head 21, and the ejected ink is discharged to the waste liquid tank 152 through the pump 150. As a result, the damper chamber 44BK of the carriage 22 is ready for the printing operation.

The predetermined period of time during which the pump 150 is driven in S100 and S120 are determined as needed. In the present embodiment, the predetermined period of time in S100 is longer than the third period of time, and the predetermined period of time in S120 is longer than the fourth period of time. Further, in the present embodiment, in S100 the fluid in the damper chamber 44CL is sucked toward the pump 150, and in S120 the fluid in the damper chamber 44BK is sucked toward the pump 150. However, the fluid in both the damper chamber 44BK and the damper chamber 44CL may be sucked toward the pump 150 at the same time. In this case, the rotary body 139 may be rotated to a rotational position where both the nozzle suction port 153BK and the nozzle suction port 153CL are communicated with the suction port 154.

The processes in S90 through S120 are an example of an idle-ejection process.

Figure 13C:
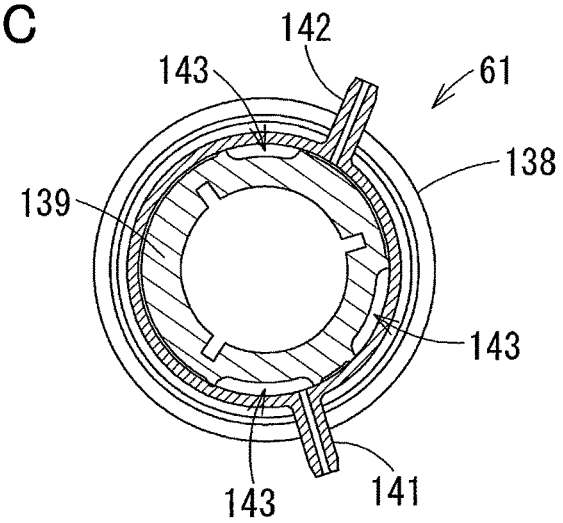
FIG. 13C is a cross-sectional view of FIG. 13A taken along a line C-C.

Finally in the initial ink introduction process, in S130 the controller 130 drives the rotary body-driving motor 174 to rotate the rotary body 139 to the rotational position α5. Accordingly, the air port 144, the nozzle suction port 153BK, and the nozzle suction port 153CL is brought into communication with the suction port 154 of the pump 150, and therefore the nozzle suction port 153BK, the nozzle suction port 153CL, and the suction port 154 are open to the atmosphere. Further, since both the first port 141 and the second port 142 are communicated with the air port through the spaces 143 (see FIG. 13C), both the storage chamber 121BK and the storage chamber 121CL are open to the atmosphere.

<Operational and Technical Advantages of the Embodiment>

During the first drive process (i.e., the process in S10 through S40) of the initial ink introduction process, ink is supplied to the storage chamber 121BK and the storage chamber 121CL as described below.

First in S10 the first switch mechanism 61 is switched to the first state and the second switch mechanism 62 is switched to the fourth state, and then in S20 the pump 150 is driven for the first period of time. Since the air flow path 120BK is communicated with the atmosphere during the process in S10 and S20, ink stored in the ink cartridge 30 attached to the cartridge-attachment portion 110 is supplied to the storage chamber 121BK of the tank 103BK due to hydraulic head difference. On the other hand, the air flow path 120CL is prevented from being communicated with the atmosphere, and the damper chamber 44CL communicated with the storage chamber 121CL is in communication with the suction port 154 of the pump 150. As a result, a negative pressure is applied to the storage chamber 121CL through the damper chamber 44CL, thereby causing the ink stored in the ink cartridge 30 attached to the cartridge-attachment portion 110CL to the storage chamber 121CL of the tank 103CL. Note that, during the process in S20, the liquid level of the ink stored in the storage chamber 121CL cannot be higher than the upper end of the communication port 128CL.

Subsequently in S30 the first switch mechanism 61 is switched to the second state and the second switch mechanism 62 is switched to the third state, and in S40 the pump 150 is driven for the second period of time. At this time, the air flow path 120CL is communicated with the atmosphere, so that ink is supplied from the ink cartridge 30 to the storage chamber 121CL of the tank 103CL due to hydraulic head difference. This allows the liquid level of the ink in the storage chamber 121CL to be higher than the upper end of the communication port 128CL. Further, communication between the air flow path 120BK and the atmosphere is interrupted, and the damper chamber 44BK communicated with the storage chamber 121BK is communicated with the suction port 154 of the pump 150. With this configuration, a negative pressure is applied to the storage chamber 121BK through the damper chamber 44BK, thereby causing the ink to be supplied from the ink cartridge 30 to the storage chamber 121BK of the tank 103BK. However, in case that the liquid surface of the ink stored in the storage chamber 121BK does not reach the upper end of the communication port 128BK during the process in S10 and S20, the liquid surface of the ink cannot be higher than the upper end of the communication port 128BK.

As described above, during the process in S10 and S20 in the first drive process (the process in S20 through S40), ink is sucked from the ink cartridge 30 to the storage chamber 121CL, and simultaneously, ink is supplied from the ink cartridge 30 to the storage chamber 121BK due to hydraulic head difference. Subsequently, in S30 and S40 in the first drive process, ink is supplied from the ink cartridge to the storage chamber 121CL due to hydraulic head difference while ink is sucked from the ink cartridge 30 to the storage chamber 121BK.

Through this process, ink stored in the ink cartridges 30 can be supplied to the storage chamber 121BK and the storage chamber 121CL in a shorter period of time than otherwise.

In the third drive process (the process in S50 through S80), ink is supplied in the storage chamber 121BK and the storage chamber 121CL, and then supplied to the damper chamber 44BK and the damper chamber 44CL, as will be described below.

First, in S50 the first switch mechanism 61 is switched to the first state and the second switch mechanism 62 is switched to the fourth state, and then in S60 the pump 150 is driven for the third period of time. In this way, the air flow path 120BK is brought into communication with the atmosphere, and therefore ink is supplied from the ink cartridge 30 to the storage chamber 121BK of the tank 103BK due to hydraulic head difference. Accordingly, the liquid level of the ink stored in the storage chamber 121BK becomes higher than the upper end of the communication port 128BK. Further, communication of the air flow path 120CL with the atmosphere is interrupted, and the damper chamber 44CL communicated with the storage chamber 121CL is in communication with the suction port 154 of the pump 150. As a result, a negative pressure is applied to the damper chamber 44CL, whereby the ink stored in the storage chamber 121CL is supplied to the damper chamber 44CL.

Subsequently, in S70 the first switch mechanism 61 is switched to the second state and the second switch mechanism 62 is switched to the third state, and in S80 the pump 150 is driven for the fourth period of time. During the process in S70, the air flow path 120CL is allowed to be communicated with the atmosphere, thereby causing ink stored in the ink cartridge 30 to be supplied to the storage chamber 121CL of the tank 103CL due to hydraulic head difference. On the other hand, the air flow path 120BK is not communicated with the atmosphere, and the damper chamber 44BK in communication with the storage chamber 121BK is communicated with the suction port 154 of the pump 150. As a result, a negative pressure is applied to the damper chamber 44BK, thereby causing the ink stored in the storage chamber 121BK to be supplied to the damper chamber 44BK.

As described above, during the process in S50 and S60 in the third drive process (the process in S50 through S80), ink stored in the storage chamber 121CL is sucked to the damper chamber 44CL concurrently with supply of ink from the ink cartridge 30 to the storage chamber 121BK due to hydraulic head difference. Then in S70 and S80, ink is supplied from the ink cartridge 30 to the storage chamber 121CL due to hydraulic head difference concurrently with suction of ink from the storage chamber 121BK to the damper chamber 44BK.

Through these operations, ink can be smoothly supplied from the ink cartridge 30 to the storage chamber 121BK of the tank 103BK, and then smoothly supplied from the storage chamber 121BK to damper chamber 44BK. Similarly, ink can be smoothly supplied from the ink cartridge 30 to the storage chamber 121CL of the tank 103C, and then smoothly supplied from the storage chamber 121CL to the damper chamber 44CL.

Further, with the initial ink introduction process according to the present embodiment, the liquid level of the ink in the storage chamber 121BK is maintained at a position above the upper end of the communication port 128BK and the liquid level of the ink in the storage chamber 121CL is maintained at a position above the upper end of the communication port 128CL until the idle-ejection process (the process in S90 through S120) has been completed. Accordingly, air in the storage chamber 121BK and the storage chamber 121CL can be prevented from flowing out to the recording portion 24.

Further, according to the present embodiment, the second switch mechanism 62 is switched interlocking relation to the first switch mechanism 61. This configuration enables the controller 130 to control both the first switch mechanism 61 and the second switch mechanism 62 by controlling only the first switch mechanism 61.

Further, according to the present embodiment, the controller 130 can switch both the states of the first switch mechanism 61 and the second switch mechanism 62 by rotating the rotary body 139.

Further, in the present embodiment, the first movable member and the second movable member are integrally formed to constitute the entire rotary body 139. Accordingly, both of the first movable member and the second movable member can be moved by one motor (i.e., the rotary body-driving motor 174).

Further, in the present embodiment, the damper chambers 44 and the suction port 154 can be communicated with each other through the flow paths 181 and the tube 147 without intervening the plurality of nozzles 29. Thus, by performing a suction operation using the pump 150 through the flow paths 181 and the tube 147, foreign matters such as air can be prevented from adhering onto or entering the nozzles 29.

Further, the storage chamber 121BK has the capacity that is greater than the capacity of the storage chamber 121CL in the present embodiment. Under such circumstance, it takes a greater time to fill the storage chamber 121BK with ink than the storage chamber 121CL. In addition, when the ink stored in the storage chamber 121BK is pigment ink while the ink stored in the storage chamber 121CL is dye ink as in the present embodiment, it takes a longer time to supply ink to the storage chamber 121BK than the storage chamber 121CL, since pigment ink has a viscosity greater than a viscosity of dye ink. With the multifunction peripheral 10 according to the embodiment, ink can be supplied preferentially to the storage chamber 121CL in which ink can be stored smoothly than the storage chamber 121BK by performing the first drive process (the process in S10 through S40). This enables the ink stored in the storage chamber 121CL to be used for another process such as the idle-ejection process within a short period of time.

<First Modification>

In the above-described embodiment, in the beginning the first switch mechanism 61 is placed in the first state while the second switch mechanism 62 is placed in the fourth state, and thereafter, the first switch mechanism 61 is placed in the second state while the second switch mechanism 62 is placed in the third state. That is, the process in S30 is executed after executing the process in S10, and the process in S70 is executed after executing the process in S50. More specifically, to the storage chamber 121BK, ink stored in the ink cartridge 30 is first supplied due to hydraulic head difference, and then supplied by suction of the pump 150 in the above-described embodiment. On the other hand, to the storage chamber 121CL, ink stored in the ink cartridge 30 is first supplied by suction of the pump 150, and then supplied due to hydraulic head difference.

However, these processes may not necessarily be executed in the sequence illustrated in FIG. 17. For example, the process in S10 may be executed after executing the process in S30, and the process in S50 may be executed after execution of the process in S70. In the flowchart illustrated in FIG. 18 according to a first modification of the embodiment, in S210 and in S250 the first switch mechanism 61 is placed in the second state while the second switch mechanism 62 is placed in the third state, and subsequently in S230 and in S270 the first switch mechanism 61 is switched to the first state and the second switch mechanism 62 is switched to the fourth state. That is, process in S230 (corresponding to the process in S10) is executed after process in S210 (corresponding to the process in S30) is executed, and process in S270 (corresponding to the process in S50) is executed after the controller 130 executes process in S250 (corresponding to the process in S70).

More specifically, in the first modification, for the storage chamber 121CL, suction of ink stored in the ink cartridge 30 by the pump 150 is performed after the ink is supplied due to hydraulic head difference; on the other hand, for the storage chamber 121BK, supply of ink stored in the ink cartridge 30 due to hydraulic head difference is performed after suction of ink by the pump 150.

Figure 18:
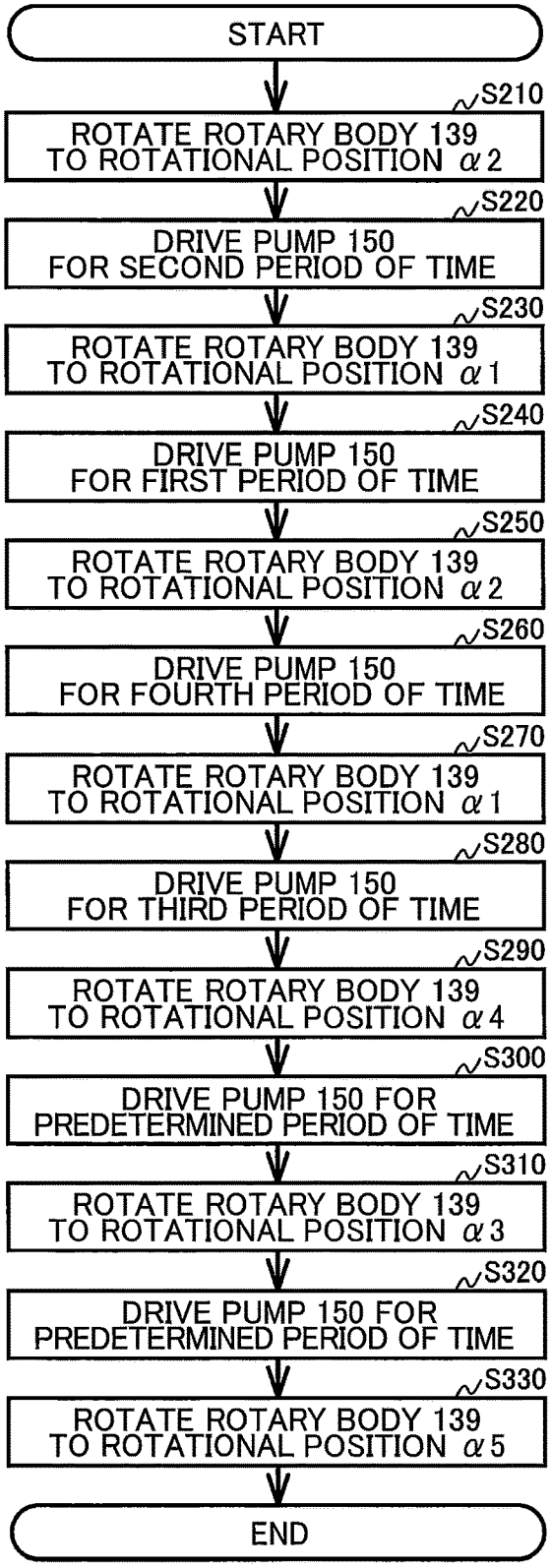
FIG. 18 is a flowchart illustrating steps in an initial ink introduction process executed by the controller 130 according to a first modification.

The process in S210, S220, S230, and S240 in FIG. 18 correspond to the process in S30, S40, S10, and S20 in FIG. 17, respectively. The process in S250, S260, S270, and S280 in FIG. 18 correspond to the process in S70, S80, S50, and S60 in FIG. 17, respectively. The process in S290, S300, S310, S320, and S330 in FIG. 18 correspond to the process in S110, S120, S90, S100, and S130 in FIG. 17, respectively.

The process in S220 through S240 is an example of a second drive process. The process in S250 through S280 is an example of a fourth drive process. The process in S290 through S320 is another example of the idle-ejection process.

In the suction operation by the pump 150 performed in S220, the liquid level of the ink in the storage chamber 121BK cannot be higher than the upper end of the communication port 128BK as similar to the process in S20 of the above-described embodiment.

In the first modification, a second period of time during which the pump 150 is driven in S220 is predetermined such that, the drive of the pump 150 for the second period of time allows the liquid level of the ink stored in the storage chamber 121BK to reach the same height as the upper end of the communication port 128BK in the up-down direction 7.

Further, in the first modification, the pump 150 is driven for a first period of time in S230. A certain amount of ink is supplied from the ink cartridge 30 to the storage chamber 121BK due to hydraulic head difference from the start of execution of the process in S230 until the process in S240 is completed (i.e., until the driving of the pump 150 for the first period of time is stopped). As in the above-described embodiment, the amount of ink supplied to the storage chamber 121BK during the process in S230 and S240 can be made large or small by setting the second period of time longer or shorter. When the rotary body 139 is rotated to the rotational position $\alpha 1$ in S230 and the pump 150 is driven for the first period of time in S240, the amount of ink supplied to the storage chamber 121BK during the process S230 and S240 becomes greater than an amount of ink that flows out through the communication port 128BK until the process in S320 (the process corresponding to the process in S120) is completed. That is, an amount of ink stored in the storage chamber 121BK at a position above the upper end of the communication port 128BK at a time of completion of the process in S240 is greater than an amount of ink that flows out from the storage chamber 121BK before the process in S320 is completed.

Further, in S260 controller 130 controls the pump-driving motor 176 to drive the pump 150 for a fourth period of time. The fourth period of time according to the first modification is longer than the second period of time in S220. Further, an amount of ink supplied from the ink cartridge 30 to the storage chamber 121CL due to hydraulic head difference from the process in S210 is started until the driving of the pump 150 for the fourth period of time is completed (i.e., an amount of ink that is supplied to the storage chamber 121CL due to hydraulic head difference during the process of S210, S220, S250, and S260) is greater than an amount of ink that flows out through the communication port 128CL due to driving of the pump 150 until the process in S320 is completed. That is, in the first modification, an amount of ink stored in the storage chamber 121CL at a position above the communication port 128CL at a time of completion of the process in S260 is greater than an amount of ink that flows out from the storage chamber 121CL until the process in S320 is completed.

Still further, in S280 the pump 150 is driven for a third period of time after the rotary body 139 is rotated to the rotational position α1 in S270. The third period of time in S280 is a time duration longer than the first period of time in S240.

According to the first modification described above, even in the second drive process (S220 to S240), ink can be stored in the storage chamber 121BK and the storage chamber 121CL in the same manner as in the first drive process (S20 to S40) although the sequence of the process is reversed with respect to the first drive process. More specifically, ink is supplied by suction from the ink cartridge 30 to the storage chamber 121BK while ink is supplied from the ink cartridge 30 to the storage chamber 121CL due to hydraulic head difference, and then ink is supplied from the ink cartridge 30 to the storage chamber 121BK due to hydraulic head difference while ink is sucked from the ink cartridge 30 to the storage chamber 121CL.

Further, in the fourth drive process (S250 to S280), ink is supplied in the same manner as in the third drive process (S50 to S80) although the sequence of the process in the fourth drive process is different from the third drive process. More specifically, ink is supplied from the ink cartridge 30 to the storage chamber 121CL due to hydraulic head difference, while ink stored in the storage chamber 121BK is sucked to the damper chamber 44BK, and then ink is supplied by suction from the storage chamber 121CL to the damper chamber 44CL, while ink stored in the ink cartridge 30 is supplied to the storage chamber 121BK due to hydraulic head difference.

<Second Modification>

In the above-described embodiment, first the first switch mechanism 61 is placed in the first state while the second switch mechanism 62 is placed in the fourth state, and thereafter the first switch mechanism 61 is switched to the second state while the second switch mechanism 62 is switched to the third state. Further, in the first modification, first the first switch mechanism 61 is placed in the second state and the second switch mechanism 62 is placed in the third state, and thereafter the first switch mechanism 61 is switched to the first state and the second switch mechanism 62 is switched to the fourth state.

Figure 19:
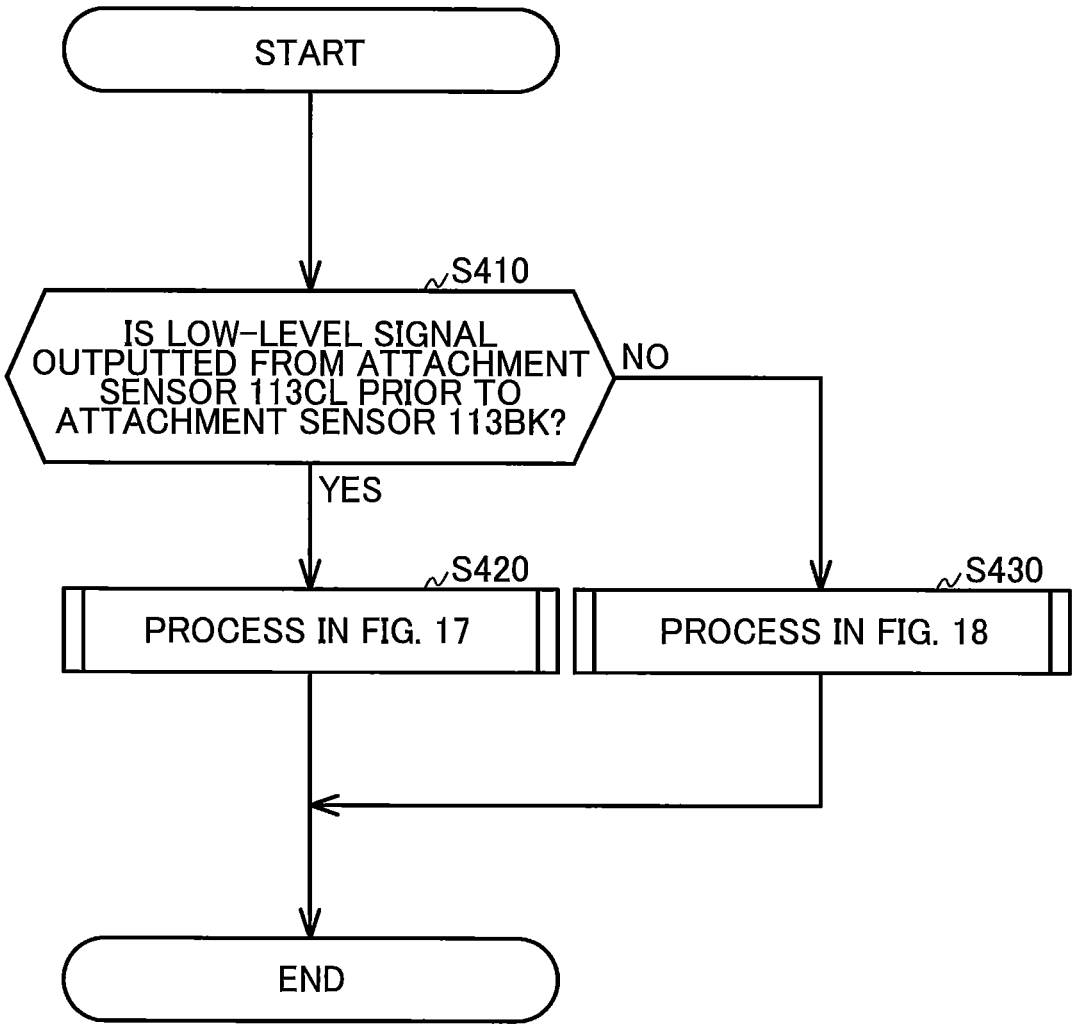
FIG. 19 is a flowchart illustrating steps in an initial ink introduction process executed by the controller 130, and illustrating a case where the controller 130 determines whether to execute one of a first drive process and a second drive process depending on sequence of attachment of the cartridge 30 to the cartridge-attachment section 110.

However, as illustrated in FIG. 19, initial states of the first switch mechanism 61 and the second switch mechanism 62 may be determined based on the sequence that the ink cartridges 30 are attached to the cartridge-attachment portion 110BK and the cartridge-attachment portion 110CL.

In the process illustrated in FIG. 19 according to a second modification of the embodiment, the controller 130 determines two signals, that is: a signal outputted from the attachment sensor 113BK; and a signal outputted from the attachment sensor 113CL. The controller 130 executes different process depending on which of the attachment sensor 113BK or the attachment sensor 113CL first outputs a low-level signal, that is, which of the cartridge-attachment portion 110BK or the cartridge-attachment portion 110CL first received the ink cartridge 30.

In S410 at the beginning of the process illustrated in FIG. 19, the controller 130 determines whether the attachment sensor 113CL has outputted a low-level signal before the attachment sensor 113BK outputs a low-level signal. When the controller 130 determines that a timing when the attachment sensor 113CL outputs a low-level signal to the controller 130 is earlier than a timing when the attachment sensor 113BK outputs a low-level signal to the controller 130 (S410: YES), that is, when the controller 130 determines that the ink cartridge 30 is attached to the cartridge-attachment portion 110CL prior to attachment of the ink cartridge 30 to the cartridge-attachment portion 110BK, in S420 the controller 130 executes the process illustrated in FIG. 17.

On the other hand, when the controller 130 determines that the timing when the attachment sensor 113BK outputs a low-level signal to the controller 130 is earlier than the timing when the attachment sensor 113CL outputs a low-level signal to the controller 130 (S410: NO), that is, when the controller 130 determines that the ink cartridge 30 is attached to the cartridge-attachment portion 110BK before the ink cartridge 30 is attached to the cartridge-attachment portion 110CL, then in S430 the controller 130 executes the process illustrated in FIG. 18.

According to the second modification, the controller 130 is configured to selectively execute one of the first drive process and the second drive process depending on whether the cartridge-attachment portion 110BK or the cartridge-attachment portion 110CL first received the corresponding ink cartridge 30. That is, when the ink cartridge 30 is firstly attached to the cartridge-attachment portion 110BK, the controller 130 executes the second drive process illustrated in FIG. 18 such that the pump 150 can suck the ink stored in the ink cartridge 30 attached to the cartridge-attachment portion 110BK. On the other hand, when the ink cartridge 30 is firstly attached to the cartridge-attachment portion 110CL, the controller 130 executes the first drive process illustrated in FIG. 17 to perform the suction operation using the pump 150, thereby sucking the ink stored in the ink cartridge 30 attached to the cartridge-attachment portion 110CL. With this control, ink can preferentially be supplied to the storage chamber 121 of the cartridge-attachment portion 110 to which the ink cartridge 30 is first attached. This allows the ink stored in the storage chamber 121 to which the ink is preferentially supplied to be used at an early stage for the subsequent process, such as the idle-ejection process.

<Other Modifications>

In the above-described embodiment and the second modification, the third drive process (that is, the process from S50 to S80) may be omitted. In this case, in the process illustrated in FIG. 17, the controller 130 executes the processes from S90 subsequently to the process in S40. Further, in the first modification and the second modification, the fourth drive process (the process from S250 to S280) may be omitted. In this case, in the process illustrated in FIG. 18, the processes from S290 are executed after the process in S240 is executed.

The first switch mechanism 61 may have a configuration different from the above-described embodiment provided that the first mechanism 61 can be switched between the first state and the second state to switch the communication state of the air flow path 120BK and the air flow path 120CL with the atmosphere.

Similarly, in the second switch mechanism 62, another configuration different from the above-described embodiment may be employed provided that the second switch mechanism 62 is configured to be switched between the third state and the fourth state so as to be capable of switching the communication state of the damper chamber 44BK and the damper chamber 44CL with the suction port 154.

The cam follower 188 may not be moved interlocking with rotation of the rotary body 139, for example. Further, for example, the upper portion of the rotary body 139 and the lower portion of the rotary body 139 may be formed as different members. That is, the upper portion of the rotary body 139 and the lower of portion of the rotary body 139 may be rotatable independently each other.

While the four ink cartridges 30 is configured to be respectively attached to the four cartridge-attachment portions 110 in the above-described embodiment, the number of the ink cartridges 30 that can be attached to the cartridge-attachment portions 110 is not limited to four. For example, two cartridge-attachment portions 110 may be provided in the multifunction peripheral 10, and two ink cartridges 30 may be attached to the corresponding cartridge-attachment portions 110. In this case, pigment ink may be stored in one ink cartridge 30, and dye ink may be stored in the remaining one ink cartridge 30.

In the above-described embodiment, communication state of the one storage chamber 121BK for storing black ink with the one damper chamber 44BK, and communication states of the three storage chambers 121CL for storing color ink with the corresponding three damper chambers 44CL are configured to be separately switched using the first switch mechanism 61 and the second switch mechanism 62. That is, the communication states of the damper chambers 44 with the storage chambers 121 are configured to be switched depending on whether the storage chamber 121 is configured to store color ink or black ink. However, alternative configuration may be employed. For example, the first switch mechanism 61 and the second switch mechanism 62 may alternately switch communication states of two storage chambers 121 storing black ink and cyan ink with the corresponding two damper chambers 44; and communication states of two storage chambers 121 storing magenta ink and yellow ink with the corresponding two damper chambers 44.

While the storage chamber 121BK has the capacity that is greater than the capacity of the storage chamber 121CL in the above-described embodiment, the capacity of the storage chamber 121BK may be equal to or smaller than the capacity of the storage chamber 121CL.

In the above-described embodiment, black ink configured to be stored in the storage chamber 121BK is pigment ink, while magenta ink, cyan ink, and yellow ink configured to be respectively stored in the three storage chambers 121CL are dye ink. However, whether pigment ink or dye ink is used for ink of each color is arbitrary. For example, black ink configured to be stored in the storage chamber 121BK may be dye ink, and each of magenta ink, cyan ink, and yellow ink configured to be stored in the corresponding three storage chamber 121CL may be pigment ink. Alternatively, for example, black ink configured to be stored in the storage chamber 121BK and magenta ink configured to be stored in the corresponding storage chamber 121CL may be pigment ink, and cyan ink and yellow ink configured to be stored in the corresponding storage chambers 121CL may be dye ink. Still alternatively, for example, ink of all colors may be pigment ink or ink of all colors may be dye ink.

In the above-described embodiment, the printer portion 11 of the multifunction peripheral 10 is a serial printer in which the carriage 22 to which the recording head 21 is mounted is reciprocatingly moved in the left-right direction 9. However, the printer portion 11 may be a line printer in which a line head that covers the entire passing area in the left-right direction 9 is mounted. In this case, the recording portion 24 includes a line head and is formed with the damper chambers 44.

While the description has been made in detail with reference to the embodiment(s) thereof, it would be apparent to those skilled in the art that many modifications and variations may be made therein without departing from the scope of the disclosure.

What is claimed is:

1. An inkjet recording apparatus to which a first cartridge and a second cartridge are attachable, the first cartridge being formed with a first storage space for storing a first ink and comprising a first air passage allowing the first storage space to be communicated with an atmosphere, the second cartridge being formed with a second storage space for storing a second ink and comprising a second air passage allowing the second storage space to be communicated with the atmosphere, the inkjet recording apparatus comprising:

a first tank comprising:

a first storage chamber for storing the first ink supplied from the first cartridge;

a first outlet port through which the first ink stored in the first storage chamber is allowed to flow out; and a first air flow path configured to allow the first storage chamber to be communicated with the atmosphere;

a second tank comprising:

a second storage chamber for storing the second ink supplied from the second cartridge;

a second outlet port through which the second ink stored in the second storage chamber is allowed to flow out; and a second air flow path configured to allow the second storage chamber to be communicated with the atmosphere;

a recording portion comprising:

a first damper chamber communicated with the first storage chamber through the first outlet port and configured to store the first ink supplied from the first storage chamber;

a second damper chamber communicated with the second storage chamber through the second outlet port and configured to store the second ink supplied from the second storage chamber; and a recording head comprising a nozzle and configured to eject the first ink stored in the first damper chamber and the second ink stored in the second damper chamber through the nozzle;

a first switch configured to be switched between a first state and a second state, the first switch in the first state allowing communication of the first air flow path with the atmosphere while interrupting communication of the second air flow path with the atmosphere, the first switch in the second state allowing the communication of the second air flow path with the atmosphere while interrupting the communication of the first air flow path with the atmosphere;

a pump comprising:

a suction port configured to allow a fluid to be sucked therethrough; and a discharge port through which the fluid sucked through the suction port is discharged;

a second switch configured to be switched between a third state and a fourth state, the second switch in the third state allowing communication of the first damper chamber with the suction port while interrupting communication of the second damper chamber with the suction port, the second switch in the fourth state allowing the communication of the second damper chamber with the suction port while interrupting the communication of the first damper chamber with the suction port; and a controller capable of controlling the first switch, the second switch and the pump, the controller being configured to perform:

after attachment of the first cartridge and the second cartridge to the inkjet recording apparatus, an initial ink introduction comprising one of:

a first drive process to drive the pump for a first period of time in a state where the first switch in the first state and the second switch is in the fourth state, to switch the first switch to the second state and to switch the second switch to the third state, and to drive the pump for a second period of time; and a second drive process to drive the pump for the second period of time in a state where the first switch is in the second state and the second switch is in the third state, to switch the first switch to the first state and to switch the second switch to the fourth state, and to drive the pump for the first period of time.

2. The inkjet recording apparatus according to claim 1, wherein the controller is further configured to perform:

after performing the first drive process, a third drive process to switch the first switch to the first state and to switch the second switch to the fourth state, to drive the pump for a third period of time longer than the first period of time, and then to switch the first switch to the second state and to switch the second switch to the third state, and to drive the pump for a fourth period of time longer than the second period of time; and after performing the second drive process, a fourth drive process to switch the first switch to the second state and to switch the second switch to the third state, to drive the pump for the fourth period of time, and then to switch the first switch to the first state and to switch the second switch to the fourth state, and to drive the pump for the third period of time.

3. The inkjet recording apparatus according to claim 2, wherein the controller is further configured to perform:

after performing the third drive process, an idle-ejection process to control the recording head to eject ink and air through the nozzle, wherein, when the first drive process is completed, an amount of the second ink stored in the second storage chamber at a position above the second outlet port is greater than a total amount of the second ink flowing out of the second storage chamber until the idle-ejection process is completed, and wherein, when the pump has been driven form the third period of time in the third drive process, an amount of the first ink stored in the first storage chamber at a position above the first outlet port is greater than a total amount of the first ink flowing out of the first storage chamber until the idle-ejection process is completed.

4. The inkjet recording apparatus according to claim 2, wherein the controller is further configured to perform:

after performing the fourth drive process, an idle-ejection process to control the recording head to eject ink and air through the nozzle, wherein, when the pump has been driven for the fourth period of time in the fourth drive process, an amount of the second ink stored in the second storage chamber at a position above the second outlet port is greater than a total amount of the second ink flowing out of the second storage chamber until the idle-ejection process is completed, and wherein, when the second drive process is completed, an amount of the first ink stored in the first storage chamber at a position above the first outlet port is performed is greater than a total amount of the first ink flowing out of the first storage chamber until the idle-ejection process is completed.

5. The inkjet recording apparatus according to claim 1, wherein the second switch is configured to be switched to the fourth state in interlocking relation to switch of the first switch to the first state, the second switch being configured to be switched to the third state in interlocking relation to switch of the first switch to the second state.

6. The inkjet recording apparatus according to claim 1, wherein the first switch includes:

a first port communicated with the first air flow path;

a second port communicated with the second air flow path; and a first movable member movable so as to switch a communication state of the first port and the second port with the atmosphere.

7. The inkjet recording apparatus according to claim 6, wherein the second switch includes:

a first flow path extending from the first damper chamber and having a tip end formed with a first opening;

a second flow path extending from the second damper chamber and having a tip end formed with a second opening;

a first valve configured to open and close the first opening;

a second valve configured to open and close the second opening;

a third flow path connected to the first opening and the second opening;

an exhaust port communicated with the third flow path through the first opening and the second opening;

a pump port communicated with the suction port;

a second movable member movable so as to switch a communication state between the exhaust port and the pump port; and a third movable member movable so as to switch opening and closing of the first opening using the first valve and to switch opening and closing of the second opening using the second valve.

8. The inkjet recording apparatus according to claim 7, wherein the third movable member is movable in interlocking relation to movement of the second movable member.

9. The inkjet recording apparatus according to claim 7, wherein the first movable member is integrally formed with the second movable member.

10. The inkjet recording apparatus according to claim 1, wherein the second switch includes a communication passage, and wherein the first damper chamber and the second damper chamber are allowed to be communicated with the suction port through the communication passage without intervening the nozzle.

11. The inkjet recording apparatus according to claim 1, wherein the first storage chamber has a capacity greater than a capacity of the second storage chamber.

12. The inkjet recording apparatus according to claim 11, wherein the controller is configured to perform the first drive process in the initial ink introduction process.

13. The inkjet recording apparatus according to claim 1, wherein the first ink is pigment ink, and the second ink is dye ink.

14. The inkjet recording apparatus according to claim 1, further comprising:

a first cartridge-attachment portion to which the first cartridge is attachable, the first ink being supplied from the first cartridge attached to the first cartridge-attachment portion to the first storage chamber;

a second cartridge-attachment portion to which the second cartridge is attachable, the second ink being supplied from the second cartridge attached to the second cartridge-attachment portion to the second storage chamber;

a first sensor configured to output a first signal when the first cartridge has been attached to the first cartridge-attachment portion; and a second sensor configured to output a second signal when the second cartridge has been attached to the second cartridge-attachment portion, wherein the controller is configured to perform:

the second drive process when the first signal is outputted from the first sensor before the second signal is outputted from the second sensor; and the first drive process when the second signal is outputted from the second sensor before the first signal is outputted from the first sensor.

* * * * *